US008033205B2

(12) United States Patent
Cross

(10) Patent No.: US 8,033,205 B2
(45) Date of Patent: Oct. 11, 2011

(54) APPARATUS FOR REMOVING SHINGLES FROM A ROOF

(76) Inventor: Edward J. Cross, Lansing, MI (US)

( * ) Notice: Subject to any disclaimer, the term of this patent is extended or adjusted under 35 U.S.C. 154(b) by 1426 days.

(21) Appl. No.: 10/894,912

(22) Filed: Jul. 20, 2004

(65) Prior Publication Data

US 2006/0026909 A1 Feb. 9, 2006

(51) Int. Cl.
*E04D 15/02* (2006.01)

(52) U.S. Cl. ..... 83/745; 83/102.1; 83/167; 30/169; 30/370; 30/371; 81/45; 299/37.1; 299/39.2

(58) Field of Classification Search ..... 30/370, 30/371, 373–377, 390, 169, 170; 81/45; 83/102.1, 167, 574; 606/82, 172, 176; 299/36.1, 299/37.1, 39.1, 39.2
See application file for complete search history.

(56) References Cited

U.S. PATENT DOCUMENTS

| | | | | | |
|---|---|---|---|---|---|
| 590,163 | A * | 9/1897 | Pearson | 30/370 |
| 995,971 | A * | 6/1911 | Keyes | 30/370 |
| 1,737,552 | A * | 12/1929 | Altman et al. | 30/370 |
| 2,139,272 | A * | 12/1938 | Jaworski | 30/370 |
| 2,344,262 | A * | 3/1944 | Odierna et al. | 30/370 |
| 2,352,432 | A * | 6/1944 | Harrington | 30/124 |
| 2,367,432 | A * | 1/1945 | Reprogle | 30/370 |
| 3,534,474 | A * | 10/1970 | Smith | 30/265 |
| 3,670,412 | A * | 6/1972 | Cunningham | 30/276 |
| 4,091,535 | A | 5/1978 | Lehrter | |
| 4,691,439 | A | 9/1987 | Marra | |
| 4,976,034 | A * | 12/1990 | Whitman | 30/370 |
| 5,001,946 | A | 3/1991 | Shirlin et al. | |
| 5,009,131 | A | 4/1991 | Alto et al. | |
| 5,098,165 | A | 3/1992 | Jacobs et al. | |
| 5,218,766 | A | 6/1993 | Himebaugh | |
| 5,800,021 | A | 9/1998 | Derr | |
| 5,819,603 | A | 10/1998 | Murray | |
| 5,918,439 | A | 7/1999 | Metzer et al. | |
| 6,257,094 | B1 | 7/2001 | Babich | |
| 6,925,917 | B2 * | 8/2005 | Tilley et al. | 83/15 |
| 2004/0103540 | A1 * | 6/2004 | Tilley et al. | 30/123.3 |

* cited by examiner

*Primary Examiner* — Clark F. Dexter
(74) *Attorney, Agent, or Firm* — Knechtel, Demeur & Samlan

(57) ABSTRACT

A roof shingle peeler device which comprises a saw blade, a motor to operate the saw blade, a horizontal arm and skiis to regulate the depth of the saw blade, a wedge to remove the nails and shingles from the roof deck and enable the saw blade to cut the shingles into a predefined section, and a frame to facilitate the transportation of the predefined section of shingles for being received and collected into a bag for disposal. A hoist and return hoist are used to pull the roof shingle peeler device up and down the roof deck from the base to the crest while removing shingles.

7 Claims, 20 Drawing Sheets

48
116
70
72
74
98
64
92
76
34
32
30
78
84
82
66
80
94
3
68
96
52
61
60
62
88
86
90
40
58
38
46
42
36
44
56
54
35
50
33

64
70
30
60
124
61
114
52
66
94
68

38
174
190
204
A

APPARATUS FOR REMOVING SHINGLES FROM A ROOF

I. FIELD OF THE INVENTION

The present invention relates to roof shingle peelers and, more specifically, to a method and apparatus for systematically removing shingles and nails from a roof deck.

II. DESCRIPTION OF THE PRIOR ART

There are generally two categories of roof shingle peelers. The first category is the roof shingle peeler that is operated manually. This manual roof shingle peeler is typically the approximate size of a shovel and has serrations at the leading edge of the shovel for prying the roofing nails from the plywood boards, thereby, detaching the shingles from the roof. Such manual roof shingle peelers include U.S. Pat. No. 5,001,946 entitled "Roof Shingle Stripping Apparatus"; U.S. Pat. No. 5,819,603 entitled "Roof Shingle Remover"; and U.S. Pat. No. 6,257,094 entitled "Roofing Shingle And Tar Paper Stripper". There is even U.S. Pat. No. 5,918,439 entitled "Roof Shingle Replacement Tool and Method" which discloses a device to install shingles on generally flat roof surfaces. The problem with these manual shingle peelers is that removing all the shingles and nails from a roof deck (e.g. for a condominium, town home, house, etc.) to install a new roof becomes a laborious, physically demanding effort that can span the course of many hours or days while further increasing the opportunity for fatigue and injury to the workers.

Recognizing this problem created the need for a more automated roof shingle peeler. This formed the second category of motor driven roof shingle peelers. These motor driven roof shingle peelers are larger than their manual counterparts and typically powered to simulate the manual operation or include vibrating or oscillating front teeth with shearing type drives to remove the shingle and nails from the roof. Such motor driven roof shingle peelers include U.S. Pat. No. 4,091,535 entitled "Shingle Stripper"; U.S. Pat. No. 4,691,439 entitled "Powered Roof Shingle Detacher And Stripper"; U.S. Pat. No. 5,009,131 entitled "Roof Shingle Stripper Apparatus"; U.S. Pat. No. 5,098,165 to Jacobs entitled "Guided Roofing Materials Removal Apparatus"; U.S. Pat. No. 5,218,766 entitled "Roofing Removal Apparatus"; and U.S. Pat. No. 5,800,021 entitled "Shingle Remover And Method Of Removing".

The most relevant is U.S. Pat. No. 4,091,535 to Lehrter entitled "Shingle Stripper." This patent discloses a guide device removably affixed to a roof that includes a cable extending between the ridge and the gutter edge of the roof. An internal combustion engine is mounted in a housing having an open forward end and a closed rear end. The engine is coupled to two drive shafts and a cable for moving the housing up the roof along the guide device from the gutter to the ridge. As the housing moves up the roof, cutters in the forward end of the housing, consisting of a first and second plurality of spaced reciprocating teeth, cut the nails of the shingles such that the shingles severed from the roof fall into and accumulate in the rear of the housing for later removal.

This device, however, has several inherent shortcomings. First, the entire system uses complex moving parts which are expensive and provide maintenance problems. This is exemplified by the gears, dual pulley, cable, and shaft arrangement, the reciprocating plurality of cutters, and the use of the internal combustion engine to move the pulleys and cables and turn the shafts. Second, due to the complexity of the system, the use of the system is limited as it is bulky, slow and too heavy. Third, although the cutters cut the nails to sever the shingles from the roof, the shingles themselves remain intact. As the device moves up the roof, this creates problems as a portion of the shingle may be severed from the roof in front of the device while the remaining portion of the shingle, not located within the front of the device, may still remain affixed to the roof causing pressure or other tension upon the system. It also requires a larger housing to collect the shingles which may likewise impede the use of the device on steep and long roofs due to the increased weight of the full shingles. Lastly, this patent does not disclose or teach the method and apparatus for removing shingles using Applicant's invention.

Likewise U.S. Pat. No. 5,098,165 to Jacobs entitled "Guided Roofing Materials Removal Apparatus" discloses a guide system which secures the shingle removal device and the operator in position on an inclined roof so that the roof can be traversed at various positions along different travel paths while being supported. The problem with this device is that it: (a) is designed solely as a guide and support member for the operator and the shingle removal device, and (b) continues to require an operator to operate the shingle removal device.

Thus, there is a need and there has never been disclosed Applicant's unique method and apparatus for removing shingles from a roof deck.

III. OBJECTS OF THE INVENTION

It is the primary object of the present invention to systematically remove shingles from a roof deck using a roof shingle peeler device. A related object of the present invention is to provide a saw blade operated by a motor and a wedge coacting to remove nails and shingles from the roof deck.

Another object of the present invention is to provide a horizontal arm and skiis to regulate the depth of the wedge and saw blade for removing and cutting the shingles.

Another object of the present invention is to provide a duct to transport the shingles into a bag for receiving and collecting all the shingles removed from the roof deck.

Another object of the present invention is to provide a hoist and return hoist enabling the roof shingle peeler device to traverse the roof deck from the base to the crest of the roof deck.

Still another object of the invention is to provide a roof shingle device that is safe and easy to use.

Other objects of the present invention will become more apparent to persons having ordinary skill in the art to which the present invention pertains from the following description taken in conjunction with the accompanying drawings.

IV. SUMMARY OF THE INVENTION

The present invention is a roof shingle peeler device which comprises a saw blade, a motor to operate the saw blade, a horizontal arm and skiis to regulate the depth of the wedge, the wedge removing the nails and shingles from the roof deck and enabling the saw blade to cut the shingles into a predefined section, and a frame to facilitate the transportation of the predefined section of shingles for being received and collected into a bag for disposal. A hoist and return hoist are used to pull the roof shingle peeler device up and down the roof deck from the base to the crest while removing shingles.

V. BRIEF DESCRIPTION OF THE DRAWINGS

The Description of the Preferred Embodiment will be better understood with reference to the following figures.

VI. DETAILED DESCRIPTION OF THE PREFERRED EMBODIMENT

Figures 1, 2, 3:
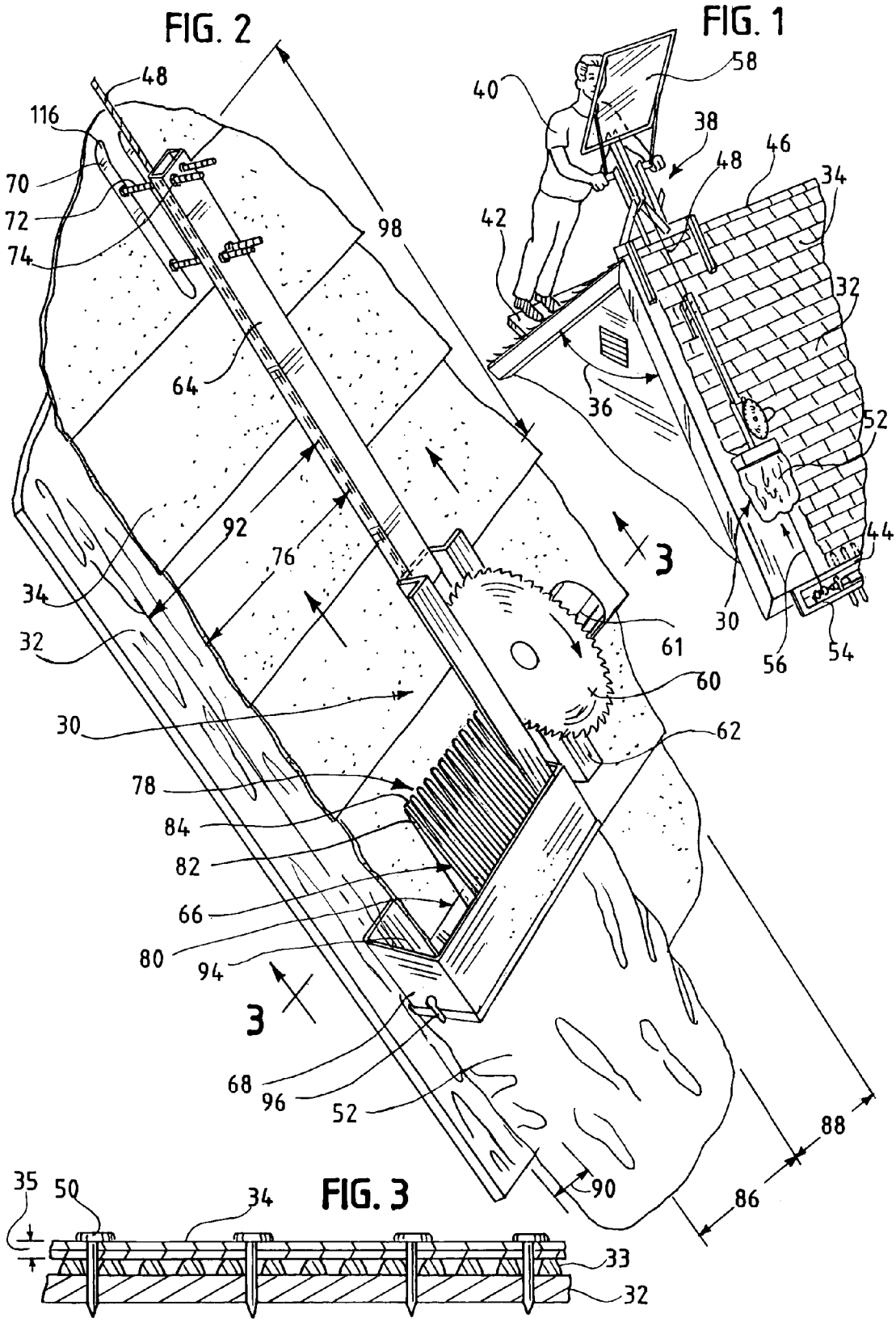
FIG. 1 is a left side perspective view of Applicant's invention on a shingled roof deck.
FIG. 2 is a left side perspective view of the roof shingle peeler device in operation.
FIG. 3 is a cross sectional view, taken along line 3-3 of FIG. 2, illustrating the shingles as installed on a roof deck.

Turning first to FIG. 1, there is illustrated a roof shingle peeler device 30 situated on a roof deck 32 which is covered by shingles 34. The roof deck 32 is typically used for a house, town home, condominium, etc. . . . Alternatively, the roof deck 32 may be used in connection with any type of dwelling, abode, storage, or any other type of building or facility that requires the use of a roof. The roof deck 32, based upon its design, forms a roof angle 36. The roof deck 32 is covered by a layer of a protective sheet 33 (FIG. 3) and then by a layer of the shingles 34. The shingles 34 are installed lengthwise into rows along the roof deck 32 from the base 44 to the crest 46. Nails 50 (FIG. 3) are used to secure both the protective sheet 33 and the shingles 34 to the roof deck 32. A typical shingle 34 has a length of substantially thirty-six inches (36") and a shingle thickness 35 (FIG. 3) of substantially one-eighth of an inch (⅛"). The protective sheet 33 and the shingles 34 coact to protect the roof deck 32 against adverse weather and to prevent leaks or other problems that may be caused by the elements.

A hoist 38, operated by a roofer 40 standing on a platform 42, pulls the roof shingle peeler device 30 up the roof deck 32 from the base 44 to the crest 46. Preferably, the hoist 38 uses a cable 48 to pull the roof shingle peeler device 30 up the roof deck 32. As the roof shingle peeler device 30 is being pulled up the roof deck 32, the roof shingle peeler device 30 removes the nails 50 and cuts the shingles 34 on the roof deck 32 into a predefined section of shingles 34. The removed nails 50 and the predefined section of shingles 34 removed from the roof deck 32 are then collected in a bag 52. After the roof shingle peeler device 30 reaches the crest 46 of the roof deck 32, a return hoist 54 uses a return cable 56 to pull the roof shingle peeler device 30 back down to the base 44 of the roof deck 32 where the roof shingle peeler device 30 originally started. This is referred to as a"strip run." The roof shingle peeler device 30 is then repositioned lengthwise along the base 44 of the roof deck 32, below another portion of shingles 34, and the process is repeated. This process continues until all of the shingles 34 and the nails 50 are removed from the roof deck 32. During this process, the hoist 38 is provided with a shield 58 to protect the roofer 40 from any loose debris or other material that may be projected from the roof deck 32 while the roof shingle peeler device 30 is in use. Preferably, the shield 58 is a transparent, plastic protective shield capable of resisting .22 caliber bullets. Such a transparent, plastic protective shield is made by Lexan.

Applicant's four embodiments for its roof shingle peeler device 30 and how each embodiment removes the shingles and nails from the roof is described in further detail below.

Turning to FIG. 2, the first embodiment of Applicant's roof shingle peeler device 30 is more clearly depicted. This embodiment is referred to herein as the "original or first embodiment." The shingle peeler device 30 consists of a saw blade 60. The purpose of the saw blade 60 is to cut the shingles 34 into predefined sections 76 for removal from the roof deck 32. The saw blade 60 is situated in a vertical position relative to the horizontal or flat shingles 34 nailed to the roof deck 32. This perpendicular relationship permits the saw blade 60 to make a clean cut through the shingles 34. As discussed in more detail below, in cutting the shingles 34, the saw blade 60 cuts through the shingle thickness 35 (FIG. 3) of the shingles 34 but does penetrate into the roof deck 32, thereby, preserving the roof deck 32 for the installation of a replacement set of shingles 34. In the preferred embodiment, the saw blade 60 is made of steel and is fourteen inches (14") in diameter. Alternatively, the saw blade 60 may be of any size provided that it is sufficient to cut through the shingles 34.

The saw blade 60 is operated by a motor 61. In the preferred embodiment, the motor 61 is an off the shelf, direct drive, three and one-half horsepower, fifteen amp motor. Alternatively, the motor 61 may be any size or horsepower provided there is sufficient power generated by the motor to permit the saw blade 60 to cut through the shingles 34.

The saw blade 60 is aligned and positioned between two parallel supporting brackets 62. The supporting brackets 62 are attached to a wedge 66 and a frame 68, at one end, and to a horizontal arm 64, at the other.

Figure 7:
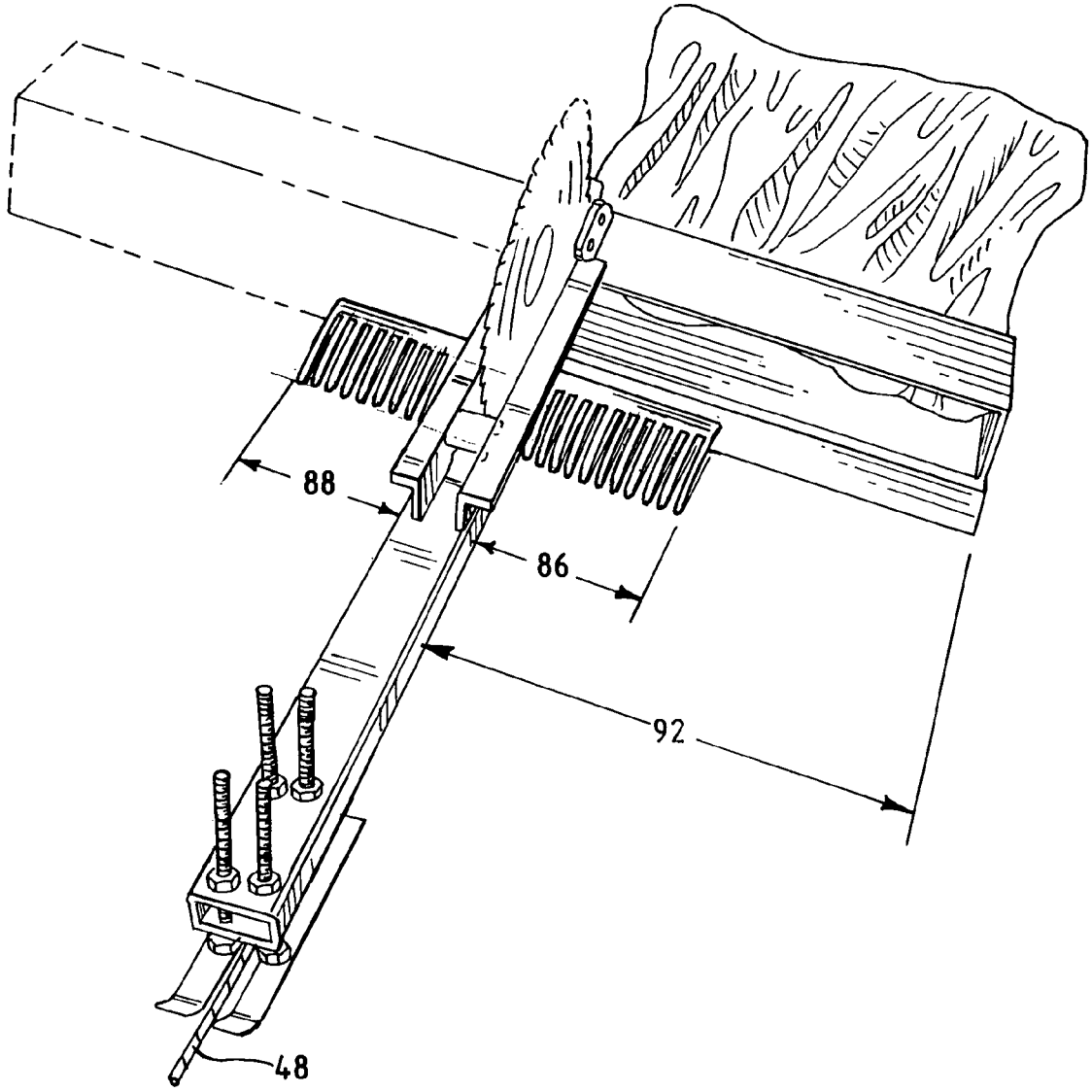
FIG. 7 is a left side, front perspective view of the roof shingle peeler device.

The wedge 66 is an elongated member that extends a width 86 in front of the frame 68 and continues a width 88 beyond the front of the frame 68 (see also FIG. 7). In the preferred embodiment, the width 86 is substantially equal to width 88 and the saw blade 60 is positioned in the center of the wedge 66 and at the right side of the frame 68 (see also FIG. 7). Alternatively, this unit of the roof shingle peeler device 30 (i.e., the saw blade 60, motor 61, supporting brackets 62, horizontal arm 64, and wedge 66) may be likewise positioned on the left side of the frame 68 as depicted in phantom in FIG. 7. In either of these locations for the roof shingle peeler device 30, the motor 61 is positioned on the opposite side of the saw blade 60 from the frame 68. The reason that the motor 61 is positioned in this manner is so that the weight of the motor 61 will counter balance the weight of the frame 68 and thereby provide a more stabilized device with the weight of the device being centrally located at the saw blade 60.

The wedge 66 has a leading edge 78 and a trailing edge 80 which are separated by teeth 82. The teeth 82 are equally spaced from one another and form channels 84 between them. At the leading edge 78, the wedge 66, when in use, is inserted under the shingles 34 such that the teeth 82 abut against the roof deck 32. The teeth 82 then gradually taper, along the vertical axis, upwardly or at an incline from the roof deck 32 to the trailing edge 80 and, along the horizontal axis, the teeth 82 extend equi-distant from one another from the leading edge 78 to the trailing edge 80 as further illustrated in FIG. 7. In the preferred embodiment, the wedge 66 is made of steel or metal. Alternatively, the wedge 66 may be made of any material provided that the material is of sufficient strength and durability for its intended purpose.

The purpose of the wedge 66 is to remove the nails 50 from the roof deck 32 and lift the shingles 34 into a position to be cut by the saw blade 60. To accomplish this, the leading edge 78 of the wedge 66 traverses the roof deck 32 from the base 44 to the crest 46. With respect to the nails 50, while traversing the roof deck 32, either: the leading edge 78 of the teeth 82 engages and forces the nails 50 into the channels 84 to be removed from the roof deck 32, and/or the nails 50 are directly received into the channels 84 and lifted from the roof deck 32 by the adjoining teeth 82 as the teeth 82 extend from the leading edge 78 to the trailing edge 80.

With respect to the shingles 34, the leading edge 78 of the wedge 66, while in use, is burrowed between the roof deck 32 and the shingles 34. As the wedge 66 proceeds up the roof deck 32, the shingles 34 traverse over the top surface of the teeth 82. As the teeth 82 incline or taper upwardly from the leading edge 78 to the trailing edge 80, the shingles 34 are lifted by the wedge 66 from the roof deck 32. Additionally, nails 50 that remain attached to the shingles 34 are removed from the roof deck 32 along with the shingles 34. The lifted shingles 34 are then cut into the predefined section 76 by the saw blade 60 and received into the frame 68.

The frame 68 is preferably a hollow, rectangular member that has a frame height 90 and a frame width 92 (see also FIG. 7). The frame height 90 is of sufficient size to accommodate the shingle thickness 35 of all the shingles 34 in the predefined section 76. The frame width 92 is of sufficient size to accommodate the width of the entire predefined section 76. The frame height 90, the frame width 92, and length of the frame 68 form a duct 94. As illustrated and in FIGS. 4 through 6, the duct 94 provides an opening in the frame 68 to receive all the shingles 34 in the predefined section 76 and facilitate the easy transportation of the predefined section 76 of shingles 34 into the bag 52.

The bag 52 is securely attached around the exterior circumference of the frame 68 by latches 96. The purpose of the bag 52 is to receive, collect, and facilitate the easy disposal of the predefined sections 76 of shingles 34 and nails 50 removed from the roof deck 32. To accomplish this, the bag 52 must be of sufficient strength and durability to avoid tearing due to the generally rigid nature of the shingles 34, the sharp edges of the shingles 34, and/or the full weight of the predefined section 76 of shingles 34 collected. In the preferred embodiment, the bag 52 is a standard grade, three milliliter (3 mil.), forty-two gallon (42 gal.) contractor bag. Alternatively, the roof shingle peeler device 30 may be used without the frame 68 and the bag 52. In this instance, the roof shingle peeler device 30 will operate as described herein except that the predefined sections 76 of shingles 34 cut from the roof deck 32 will remain loose on the roof deck 32 until manually bagged and discarded by the users.

The horizontal arm 64 extends outwardly a distance 98 from the supporting brackets 62 terminating in skiis 70. The purpose of the horizontal arm 64 is twofold: (1) to provide appropriate leverage in pulling the roof shingle peeler device 30 up the roof deck 32, and (2) enable the wedge 66 and the saw blade 60 to be positioned relative to the roof deck 32 and shingles 34 such that the saw blade 60 can cut and separate the predefined section 76 from the remaining shingles 34 and do so without damaging the roof deck 32. The appropriate leverage is accomplished by providing the proper distance 98. In the preferred embodiment, the distance 98 is substantially twenty inches (20"). The horizontal arm 64 is also positioned such that the vertical centerline of the horizontal arm 64 corresponds to the vertical centerline of the saw blade 60. The positioning of the saw blade 60 relative to the roof deck 32 and shingles 34 is accomplished by the combination of distance 98 of the horizontal arm 64 and the skiis 70. The horizontal arm 64 and the skiis 70 are preferably made of steel or metal.

The skiis 70 are attached to the horizontal arm 64 by threaded screws 72 and corresponding fasteners 74 located on both sides of the horizontal arm 64. In this manner, if the horizontal arm 64 is desired to be raised higher (i.e., raise the saw blade 60 in relation to the shingles 34 and roof deck 32), the fasteners 74 on the top side of the horizontal arm 64 are raised to the desired height, the horizontal arm 64 is correspondingly lifted to that height, and the fasteners 74 located on the underside of the horizontal arm 64 are likewise raised to secure the horizontal arm 64 into that desired height. If, on the other hand, the horizontal arm 64 is desired to be lowered (i.e., lower the saw blade 60 more into the shingles 34 and closer to the roof deck 32), the opposite occurs. The fasteners 74 located on the underside of the horizontal arm 64 are lowered to the desired height, the horizontal arm 64 is correspondingly lowered to that height, and the fasteners 74 located on the top side of the horizontal arm 64 are then lowered to secure the horizontal arm 64 into that desired height.

The purpose of the skiis 70 is to control and stabilize the cable 48 located between them thereby reducing the yaw of the cable 48. The fasteners 74 are each provided with sleeves (not illustrated) to assist in securing the cable 48 between the skiis 70. Preferably, the sleeves are made of brass which is less abrasive on the cable 48.

The skiis 70 also have ski tips 116 which permit the skiis 70 to easily traverse over the roof deck 32 without getting hooked or caught in the shingles 34 or in any other manner inhibiting the forward motion of the device.

Alternatively, in lieu of using the skiis 70, it is contemplated that wheels or any other adjustable means may be used. The adjustable means should also sufficiently support the horizontal arm 64 and traverse the roof deck with minimal friction or difficulty.

Figure 4:
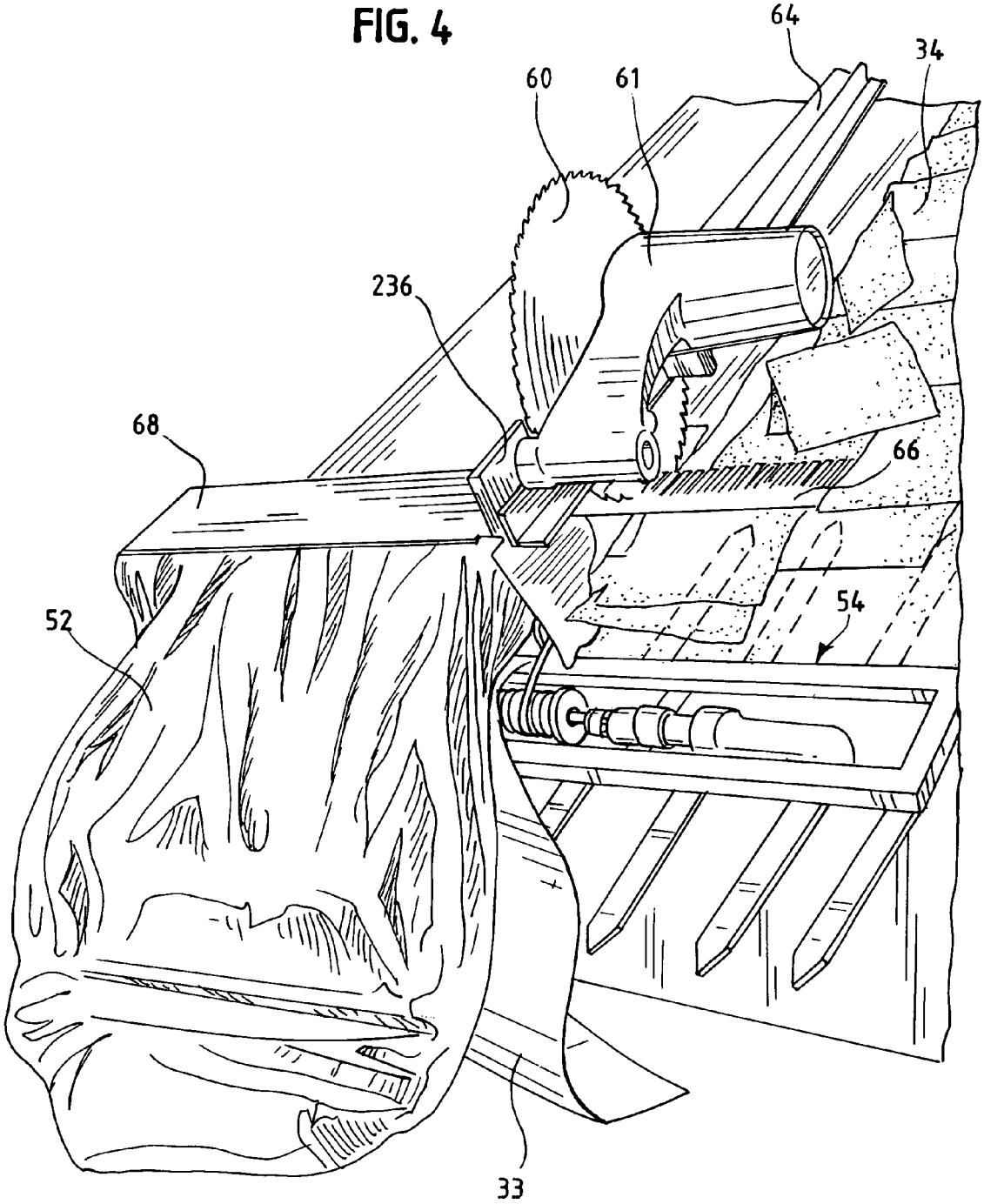
FIG. 4 is a right side perspective view illustrating the roof shingle peeler device as it begins at the base to remove the predefined section of shingles and nails from the roof deck.
Figure 5:
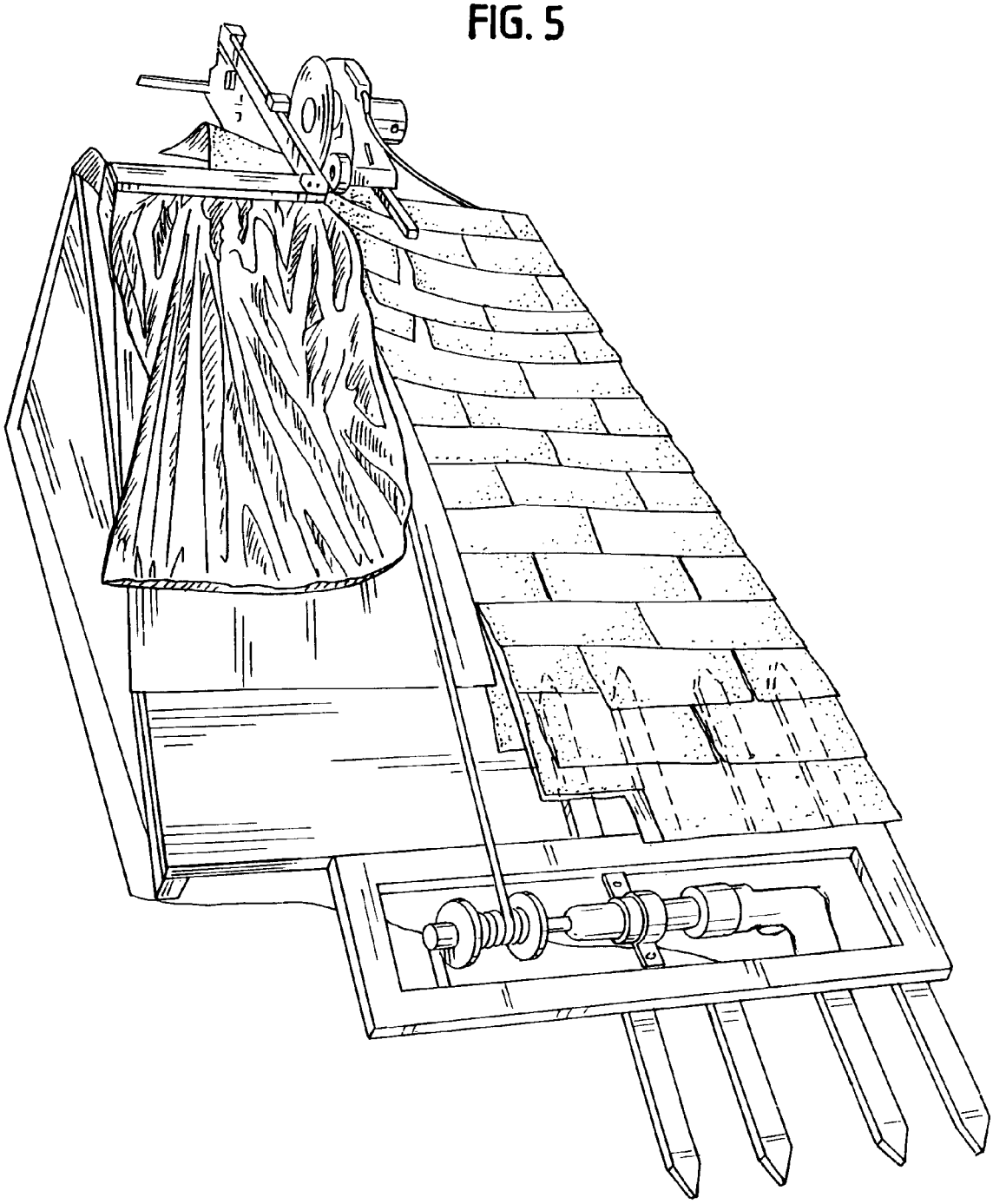
FIG. 5 is a left side perspective view illustrating the roof shingle peeler device in the middle of the roof deck and removing the predefined section of shingles from the roof deck.
Figure 6:
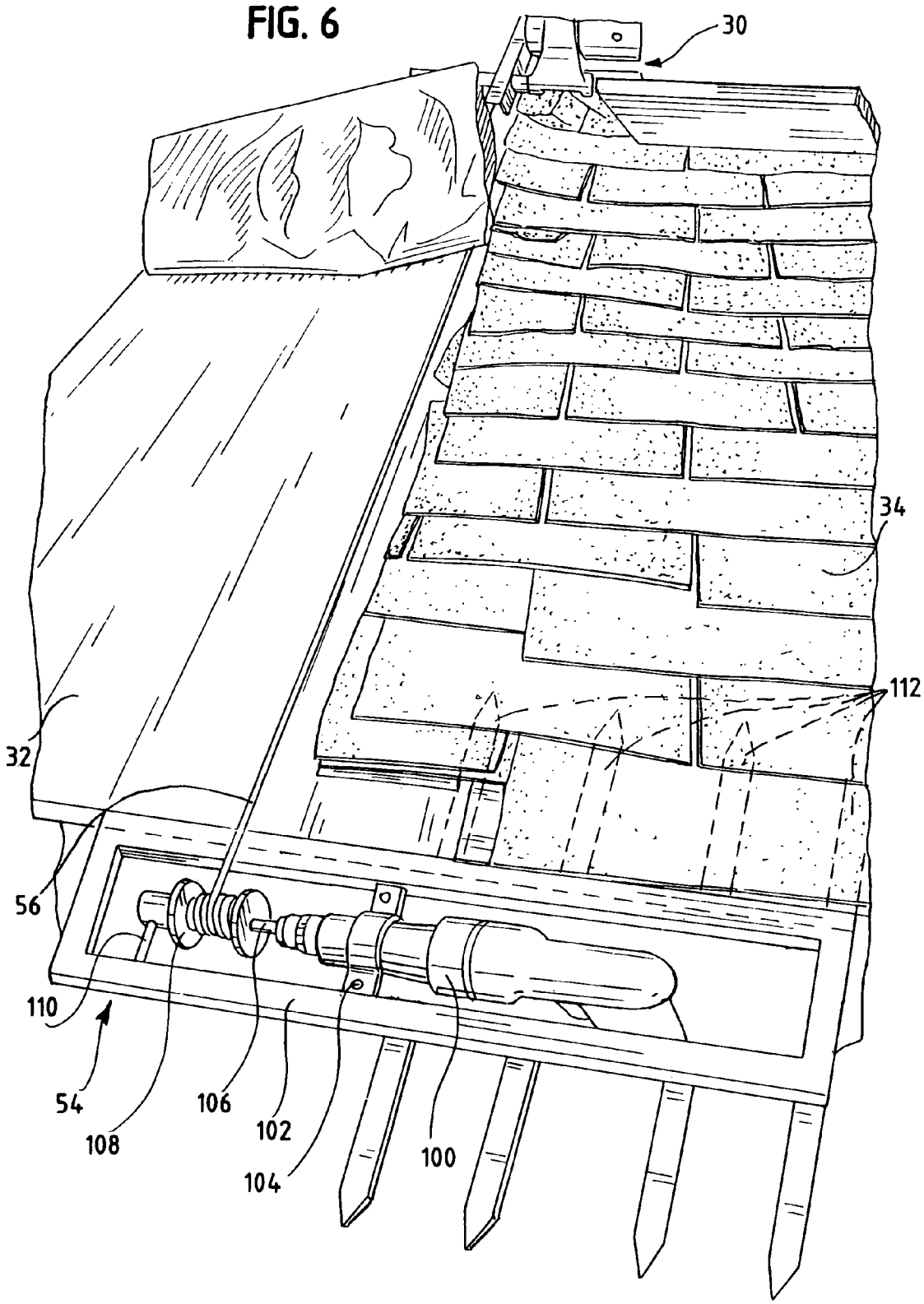
FIG. 6 is an end perspective view illustrating the roof shingle peeler device at the crest of the roof deck after removing a predefined section of shingles from the roof deck.

FIGS. 4, 5, and 6 depict the roof shingle peeler device 30 traversing the roof deck 32 from the base 44 to the crest 46. As previously discussed, the predefined section 76 of the shingles 34 are collected in the bag 52. With respect to the shingles 34 that are adjacent to the predefined section 76 and outside the frame 68, as the roof shingle peeler device 30 traverses the roof deck 32, the width 88 of the wedge 66 removes the nails 50 from the shingles 34 that it is under. As a result, when the roof shingle peeler device 30 is repositioned to remove the next set of predefined section 76 of shingles 34 from the roof deck 32, these adjacent shingles 34, with removed nails 50, will form the left portion of the next set of predefined section 76 of shingles to be removed. In this manner, as the nails 50 have already been removed from the next set of predefined section 76 of shingles 34, the width 86 of the wedge 66 will be directed to the remainder of the nails 50 and shingles 34 in that predefined section 76 for removal and collection into the bag 52.

The return hoist 54 enables the roof shingle peeler device 30 to be pulled back down the roof deck 32, from the crest 46 to the base 44, to where the roof shingle peeler device 30 originally started. The roof shingle peeler device 30 and the return hoist 54 are then correspondingly repositioned along the roof deck 32 to the right. Alternatively, if the unit was affixed to the left side of the frame 68, the roof shingle peeler device 30 would remove the shingles 34 from the roof deck 32 in the opposite direction starting on the right edge of the roof deck 32 and repositioning left along the roof deck 32 until all the shingles 34 have been removed.

Figure 12:
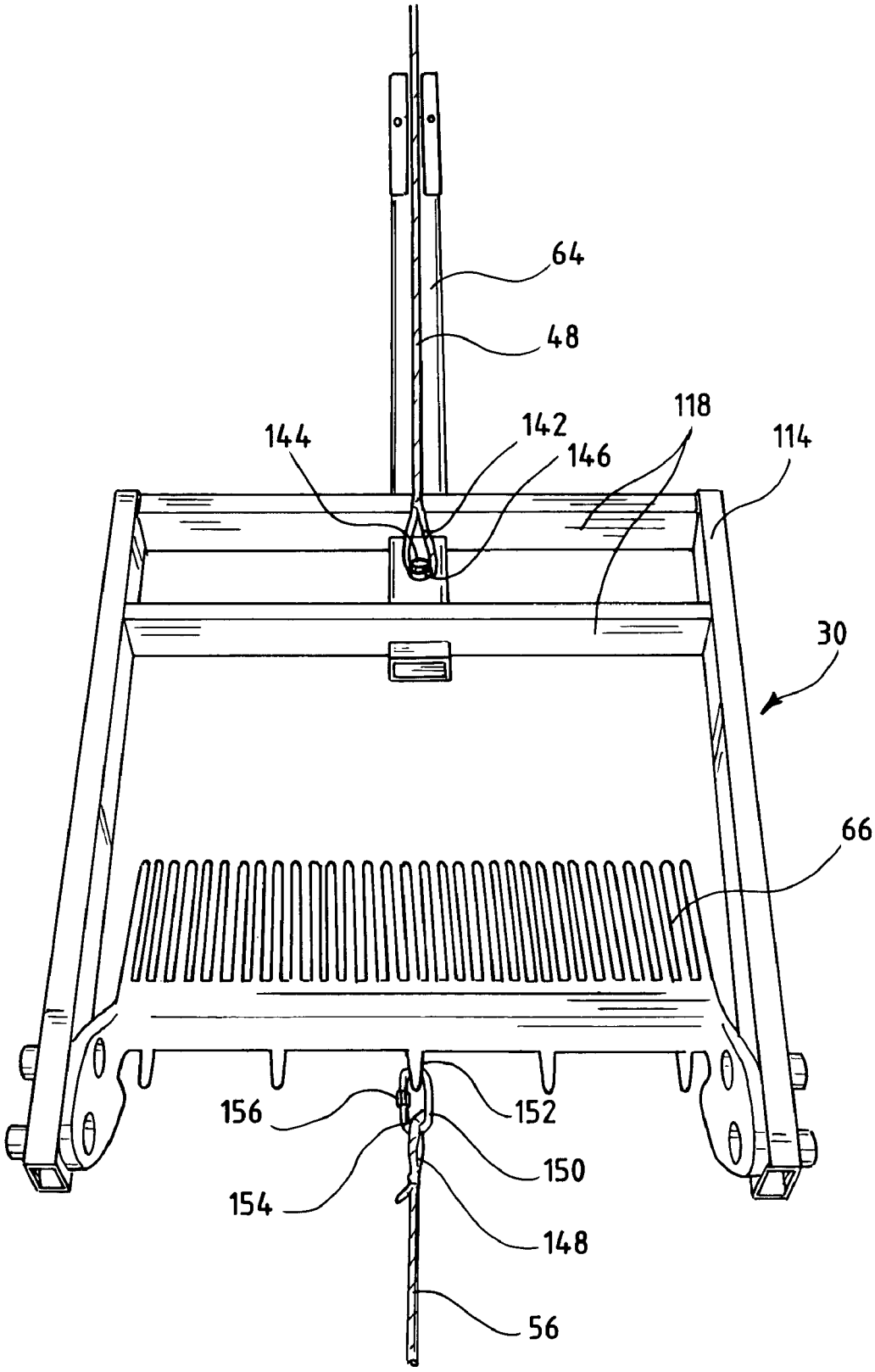
FIG. 12 is a bottom view of the attachment of the hoist and return hoist cables to the roof shingle peeler device.

As more clearly illustrated in FIG. 6, the return hoist 54 consists of a motor 100 secured to a housing 102 by a clamp 104. A drive shaft 106 extends outwardly from the motor 100 and attaches to a spool 108 containing the return cable 56. The spool 108 is likewise attached to the housing 102 by a bar 110. The housing 102 provides blades 112 to insert between the shingles 34 and the roof deck 32, thereby, securing the return hoist 54 in position while the roof shingle peeler device 30 is in use during a strip run. When the roof shingle peeler device 30 traverses from the base 44 to the crest 46 of the roof deck 32, the spool 108 of the return hoist 54 permits the return cable 56, which is attached to the roof shingle peeler device 30 as illustrated in FIG. 12, to follow the roof shingle peeler device 30 to the crest 46. Preferably, the return cable 56 is in the same vertical centerline of the saw blade 60. When the roof shingle peeler device 30 is ready to be returned to the base 44 for repositioning, the motor 100 is activated to rotate the drive shaft 106 and pull the roof shingle peeler device 30 back to the base 44 of the roof deck 32. In the preferred embodiment, the motor 100 is at least a 9 amp, variable speed, reverse alternating current (AC) or direct current (DC) motor.

Figure 8:
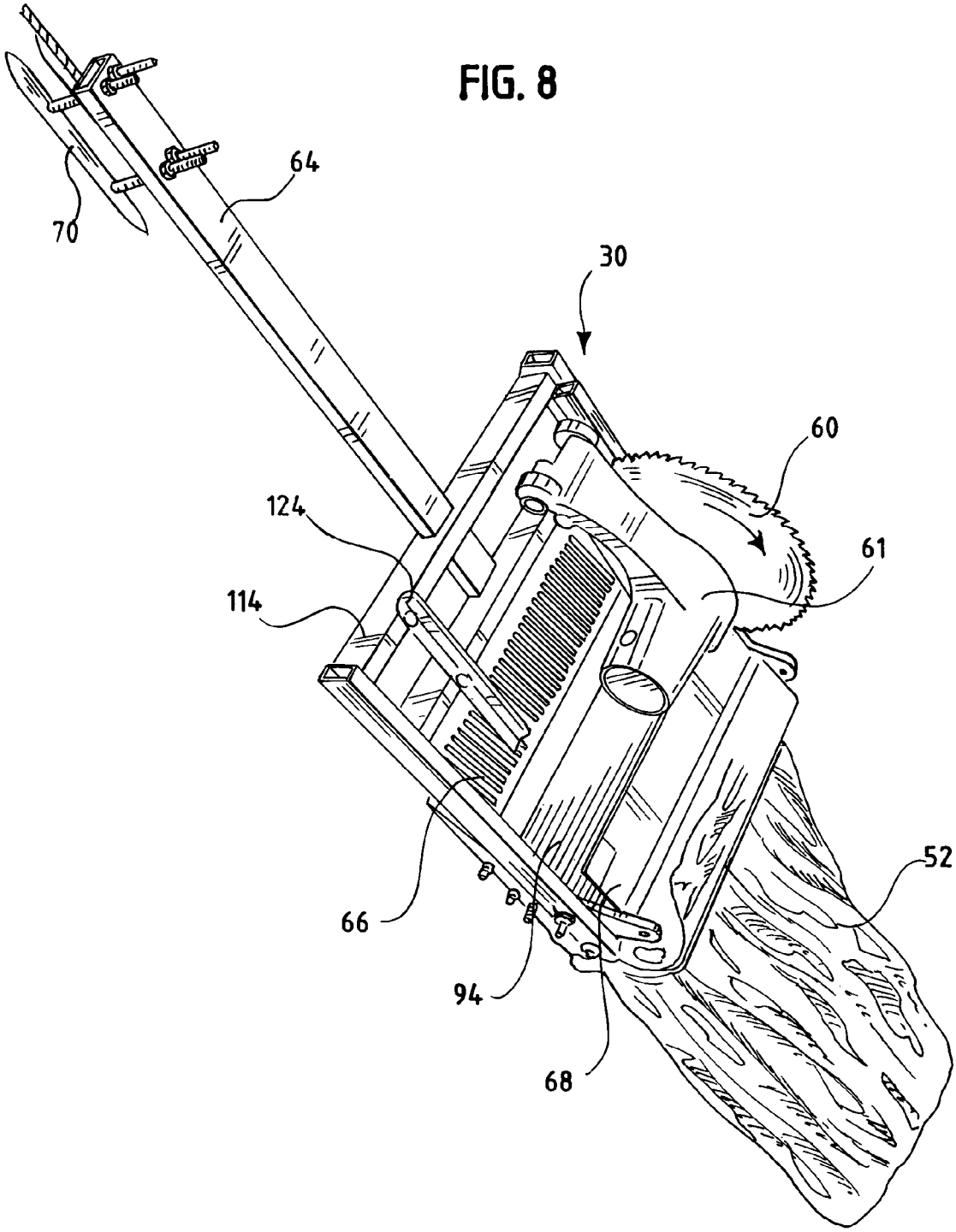
FIG. 8 is a left side perspective view of a second embodiment of the roof shingle peeler device.

Turning to FIG. 8, the second embodiment of Applicant's roof shingle peeler device 30 is more clearly depicted. This embodiment is referred to herein as the "second embodiment." There are four differences between this embodiment and the original embodiment. First, the horizontal arm 64 is positioned directly in the center of the frame 68. Second, the parallel supporting brackets 62 have been replaced with a square frame 114. Third, although the horizontal arm 64 has been relocated, the saw blade 60 remains, as illustrated here, on the right side of the frame 68. With the unit located on the right side of the frame 68, the motor 61 is now repositioned on the left side of the saw blade 60. This is opposite to where the motor 61 is located in the original embodiment. Lastly, the entire wedge 66 is placed directly in front of the frame 68. In this second embodiment, the roof shingle peeler device is simpler and more stabilized.

Figure 9:
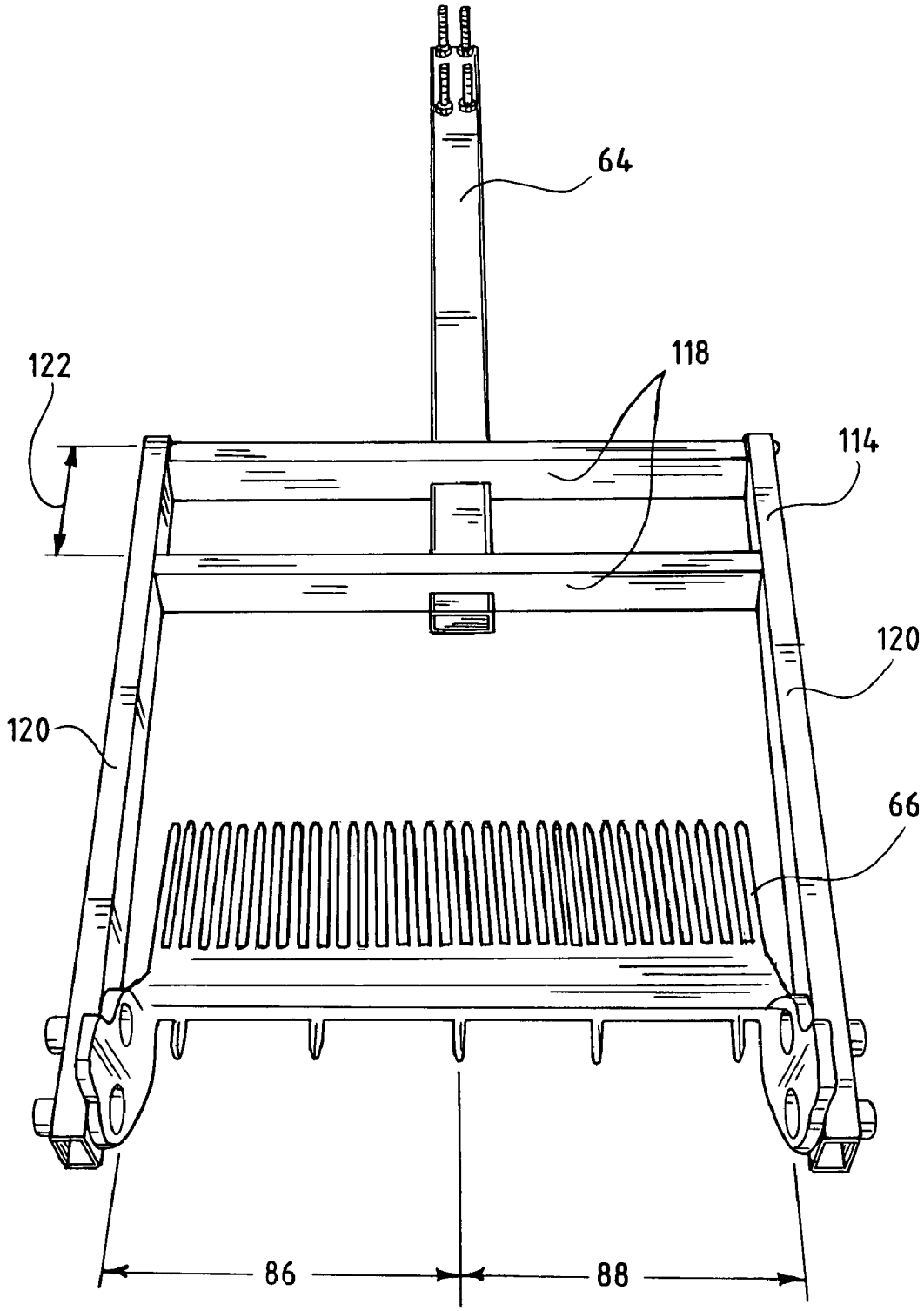
FIG. 9 is a top perspective view, with portions removed, of the second embodiment of the roof shingle peeler device.

The horizontal arm 64 and the skiis 70 remain the same as disclosed in the original embodiment. The square frame 114, illustrated in more detail in FIG. 9, provides two parallel front bars 118 each connected to two opposed side bars 120. The front bars 118 are separated from one another by a front bar distance 122. In the preferred embodiment, the front bar distance 122 is substantially four and one-half inches (4½"). The front bars 118 each have a bore (not illustrated) centrally located for receiving and retaining the horizontal arm 64. As a result, the parallel front bars 118 provide increased support and stability to the device thereby inhibiting the yaw, pitch, and/or torque that may be experienced or created by the horizontal arm 64 as it traverses the roof deck 32.

Figure 10:
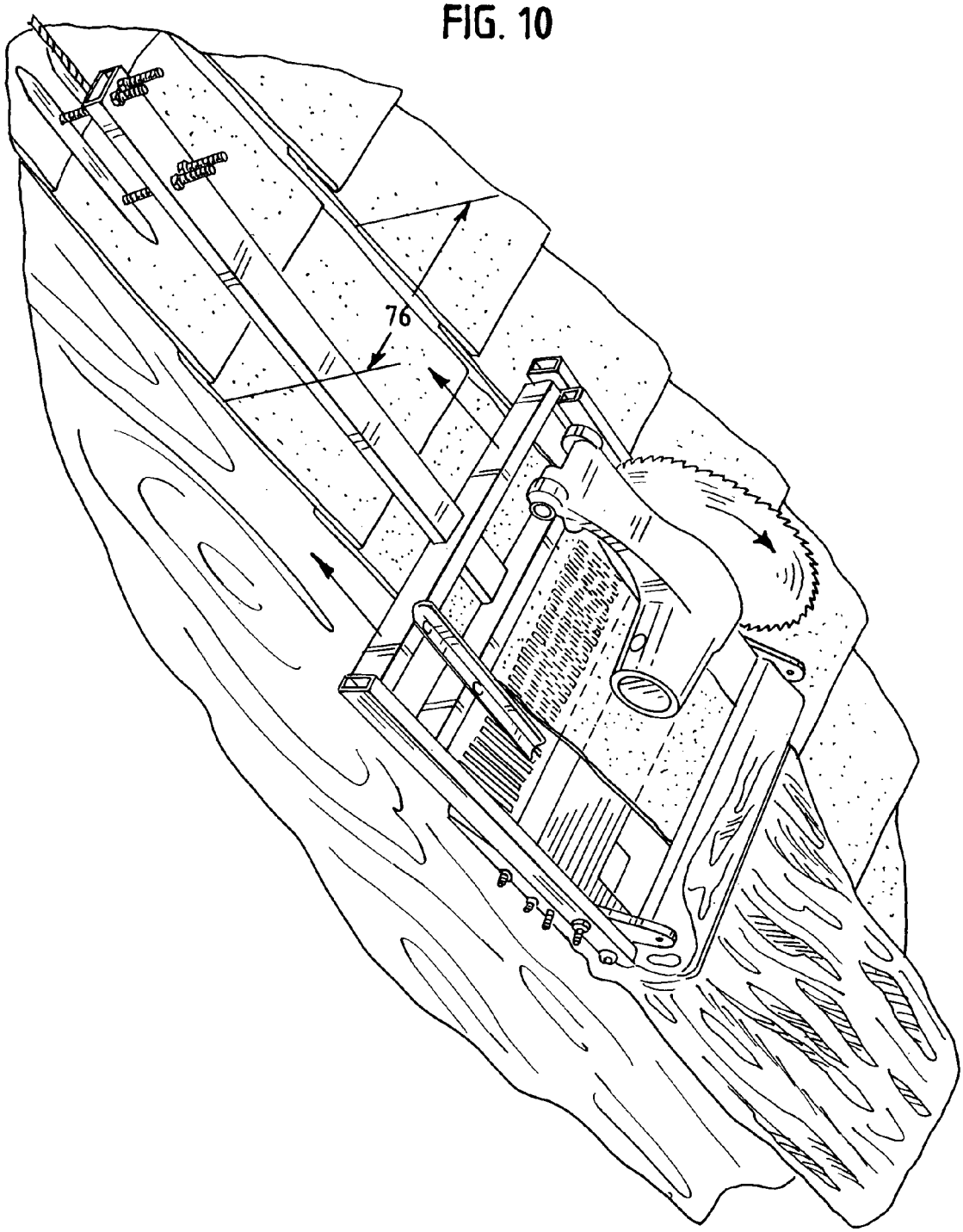
FIG. 10 is a left side perspective view of the second embodiment of the roof shingle peeler device in operation.

The wedge 66 is the same wedge as disclosed in the original embodiment. In the second embodiment, the entire width 86 and 88 of the wedge 66 is located along the frame width 92. With the wedge 66 as positioned, the roof shingle peeler device 30 will remove the shingles 34 into a larger predefined section 76 than in the original embodiment. Preferably, the second embodiment, in operation as illustrated in FIG. 10, will remove a predefined section 76 that is substantially twice as large as the predefined section 76 in the original embodiment and require approximately half as many strip runs.

The square frame 114 is also provided with an L-shaped support member 124 (FIG. 8). The L-shaped support member 124 is used to secure the saw blade 60 and motor 61 into position on either the right or the left side of the square frame 114. As the skiis 70, the horizontal arm 64, and the square frame 114 are all centered in relation to the wedge 66 and frame 68, the motor 61 is positioned on the inside of the saw blade 60 within the square frame 114. This assists in centralizing the weight of the motor 61 with the entire device and in creating a more stabilized device.

The wedge 66, the frame 68, duct 94, and bag 52 are the same, in this second embodiment, as that disclosed in the original embodiment.

Figure 11:
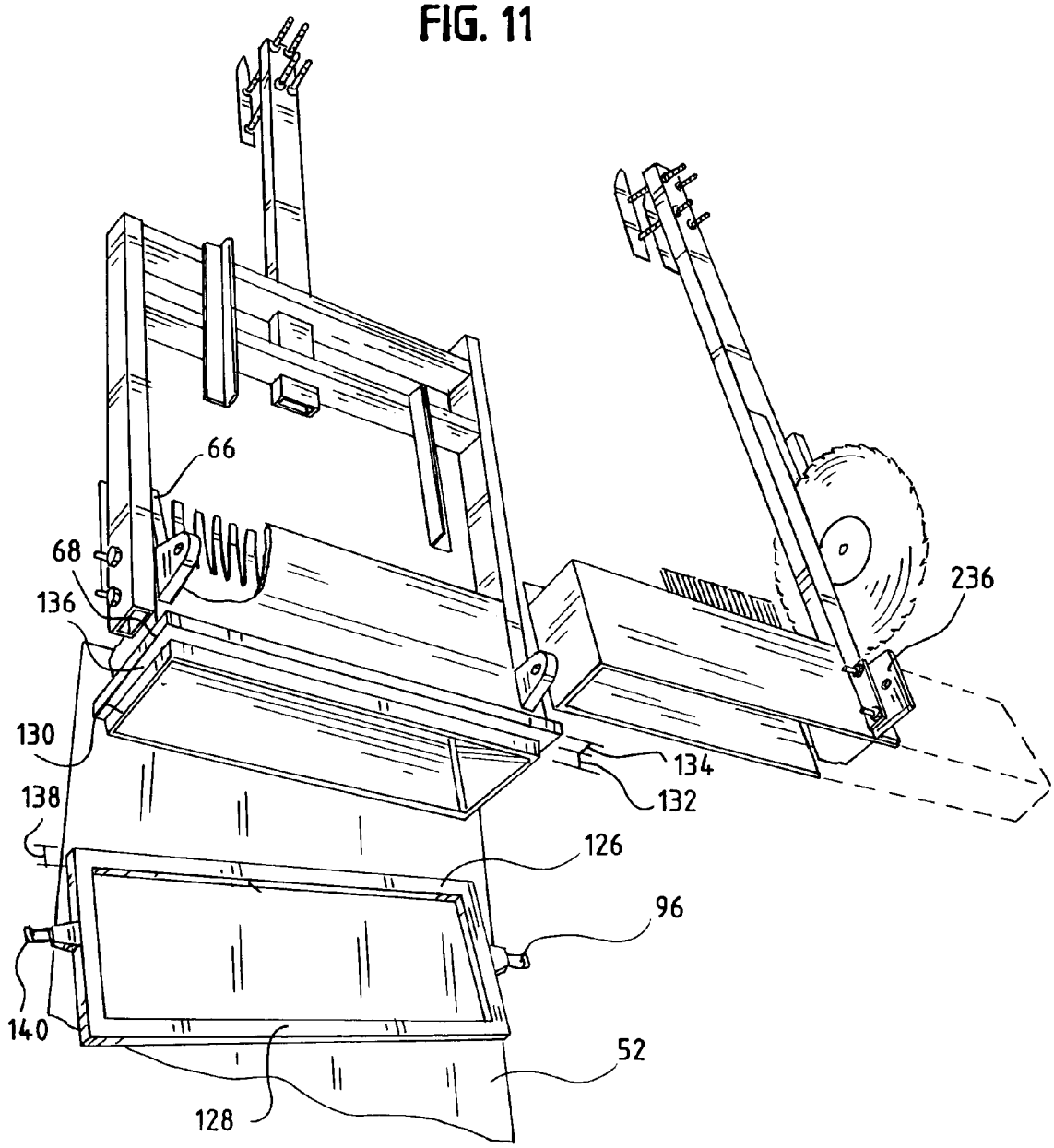
FIG. 11 is a left side perspective view, with portions removed, of both the original and second embodiments of the roof shingle peeler device.

FIG. 11 more clearly illustrates the attachment of the bag 52 to the frame 68. The frame 68 provides a rectangular ledge 130, located on the opposite side of the wedge 66, around the exterior circumference of the frame 68. The rectangular ledge 130 is positioned a border distance 134 from the outermost exterior edge of the frame 68 and extends outwardly from the frame 68 a ledge thickness 132. In the preferred embodiment, the border distance 134 is substantially equal to the ledge thickness 132. As a result, this forms a uniform ridge 136 around the exterior circumference of the frame 68. As discussed previously, the bag 52 is folded around the exterior circumference of the frame 68 and the ledge 130. A rectangular holder 126 having four rigid sides 128 of a uniform holder thickness 138 and forming a hollow center is inserted over the exterior of the bag and into the ridge 136. As the holder thickness 138 of the rectangular holder 126 is substantially equal to the ledge thickness 132 and border distance 134, the bag 52 becomes secured between the rectangular holder 126, the ledge 130, and the frame 68 which are each flush with one another and providing an equal and opposite force for securing the bag 52 between them. The latches 96 have claws 140 that frictionally grip the frame 68 to secure the holder 126 to the frame 68.

In FIG. 12, the attachment of the hoist cable 48 and the return cable 56 of the return hoist 54 to the roof shingle peeler device 30 are more clearly illustrated. The hoist cable 48 extends from the hoist 38, between the skiis 70, and attaches to the horizontal arm 64 between the front bars 118. In the preferred embodiment, the hoist cable 48 is formed into a loop 142 which is secured to the horizontal arm 64 by a bolt 144. Alternatively, it is contemplated that any other means that is known in the art may be used to secure the hoist cable 48 to the horizontal arm 64. The bolt 144 has a flat bottom 146 that, upon tightening the bolt 144, holds the hoist cable 48 to the horizontal arm 64. The hoist cable 48 is also attached in this location such that the skiis 70 and horizontal arm 64 can be sufficiently pulled into the hoist 38 for enabling the roof shingle peeler device 30 to cut the predefined section 76 of shingles 34 all the way up to the crest 46 of the roof deck 32.

The return cable 56 also has a loop 148 formed into its end. The loop 148 is attached to a handle 150. Preferably, the handle 150 forms a ring 154 and utilizes a latch 156 for opening and closing the ring 154 to receive the loop 148 of the return cable 56. The ring 154 also receives a finger loop 152 on the wedge 66. In this manner, the return cable 56 is secured to the roof shingle peeler device 30. Alternatively, it is contemplated that any other means may be used to secure the return cable 56 to the roof shingle peeler device 30 provided that this alternate securing means is of sufficient strength for the return hoist 54 to pull the roof shingle peeler device 30 back down the roof deck 32 from the crest 46 to the base 44.

Figure 13:
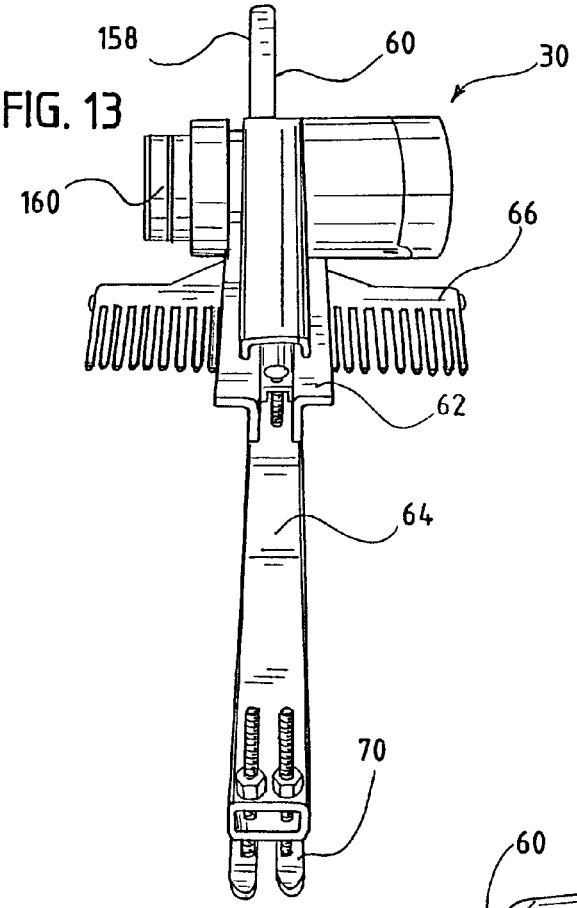
FIG. 13 is a front perspective view of a third embodiment of the roof shingle peeler device.

Turning to FIG. 13, the third embodiment of Applicant's roof shingle peeler device 30 is more clearly depicted. This embodiment is referred to herein as the "third embodiment." In this third embodiment, the saw blade 60, the supporting brackets 62, the wedge 66, the horizontal arm 64, the skiis 70, and bag 52 are all the same as that disclosed in the original and/or second embodiments. The roof shingle peeler device 30 also uses the same hoist 38 and return hoist 54 for traversing the roof deck 32.

Figure 14:
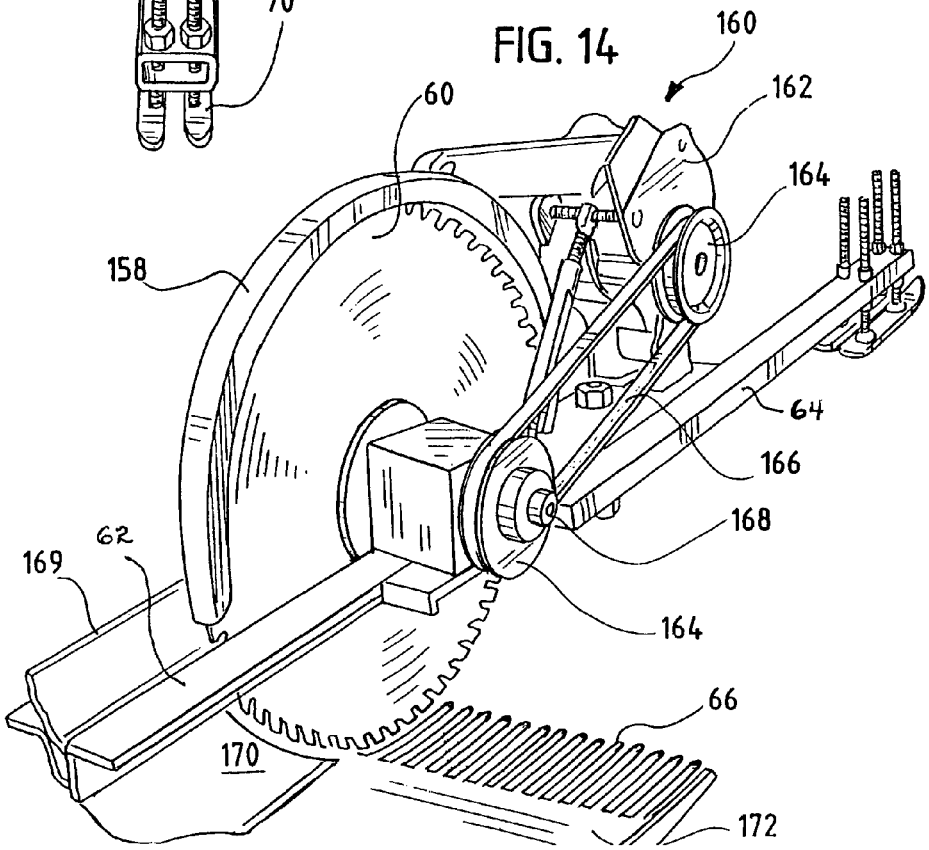
FIG. 14 is a right side perspective view of an embodiment similar to the third embodiment of the roof shingle peeler device and, in particular, illustrating the pulley motor that operates the device.

The roof shingle peeler device 30 does, however, comprise a belt drive or pulley motor assembly 160 to operate the saw blade 60. In the preferred embodiment, the pulley motor assembly 160 includes a motor 162 that is a 15 amp, 3½ horsepower electric alternating current (AC) or gas motor. The motor 162 is also energized by 110 volts. As this is the same voltage that is provided by a typical house electrical outlet, the pulley motor assembly 160 is ideal for use with the roof shingle peeler device 30 as it eliminates the necessity of having to provide a portable electrical generator to run the motor 61 of the original and second embodiments. As illustrated in FIG. 14, the pulley motor assembly 160 comprises the motor 162, two pulleys 164 connected by a driving belt 166, and a drive shaft 168 for engaging the saw blade 60. A cover 158 is provided for protecting the users from potential injury resulting from the saw blade 60, especially when in use.

A supporting bracket 169 having a vertical plate 170 is attached to a horizontal plate 172 of the wedge 66. The vertical plate 170 is positioned directly behind the saw blade 60 and the wedge 66. In use, the nails 50 and shingles 34 of the roof deck 32 are removed and cut, as described previously, by the combination of the wedge 66 and saw blade 60. As the shingles 34 proceed beyond the wedge 66 and saw blade 60, the shingles 34 cut by the saw blade 60 are divided or separated by the vertical plate 170 with the shingles 34 on the left side of the saw blade 60 being directed by the vertical plate 170 to the left side of the saw blade 60 and the shingles 34 on the right side of the saw blade 60 being directed by the vertical plate 170 to the right side of the saw blade 60. The portion of the shingles 34 that do not engage the vertical plate 170 will otherwise pass over the top of the horizontal plate 172. As a result, the vertical plate 170 facilitates the division or separation of the cut or removed shingles from the shingles that remain attached to the roof deck and enables the roof shingle peeler device to continue to traverse the roof deck uninhibited by the shingles still attached to the roof deck.

The benefits of this third embodiment are that: (1) the motor 162 provides a more convenient and efficient motor; (2) in the original and second embodiments, the roof shingle peeler device started to remove shingles from the roof deck from either the left or right side of the roof deck depending upon whether the saw blade was located on the right or left side of the device, respectively. With the motor 162, saw blade 60, wedge 66, horizontal arm 64, and skiis 70 all positioned in the same vertical centerline, the roof shingle peeler device in this third embodiment can start to remove shingles from the roof deck from any location on the roof deck; (3) the vertical plate 170 assists in the division or separation of the shingles and the movement of the device up the roof deck is not restrained or inhibited by the cut or removed shingles or the shingles that remains attached to the roof deck and have yet to be removed; (4) the roof shingle peeler device can operate with or without the bag; and (5) provides a more balanced device.

Figure 15:
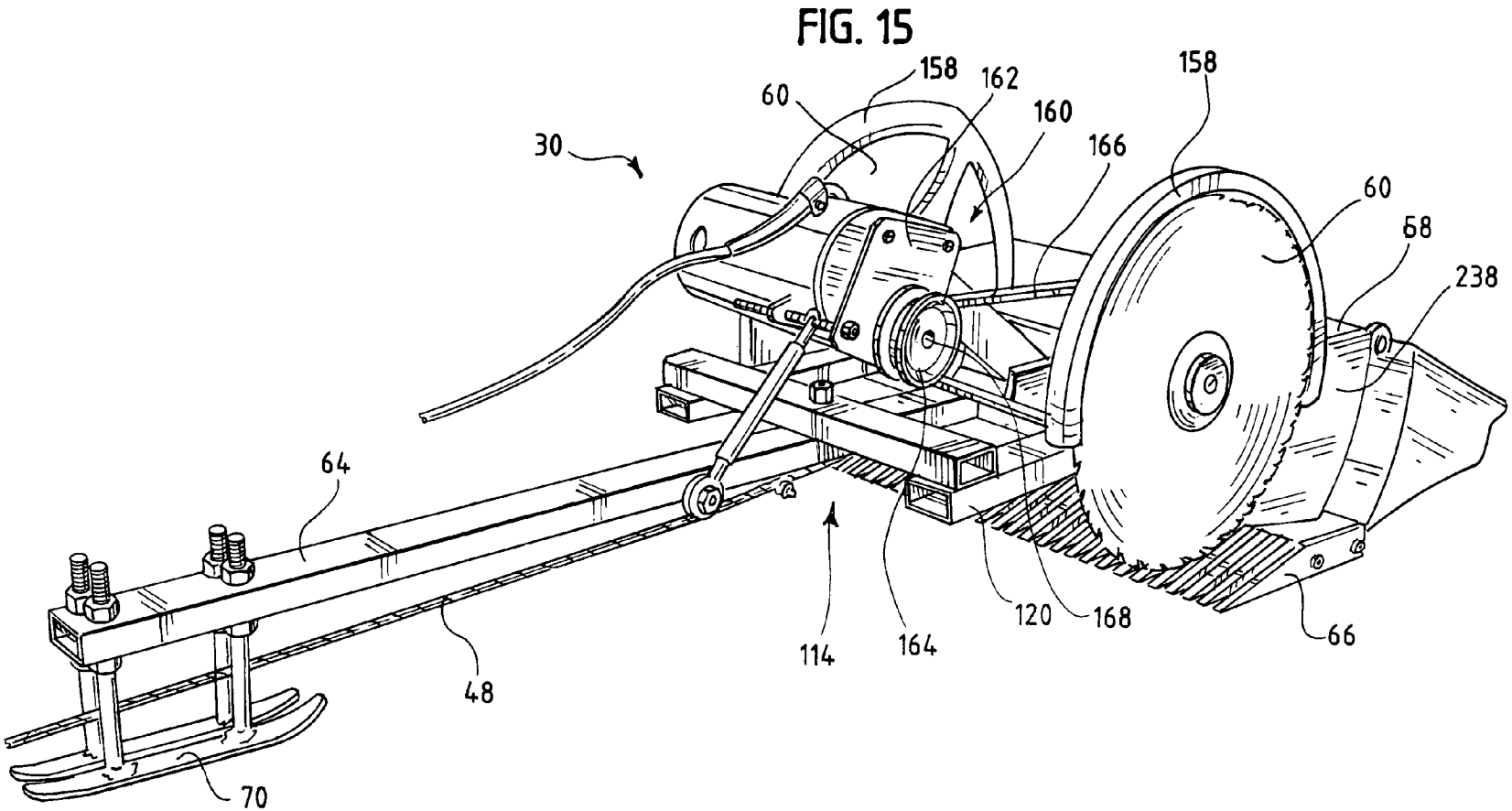
FIG. 15 is a left side perspective view of a fourth embodiment of the roof shingle peeler device.

Turning to FIG. 15, the fourth embodiment of Applicant's roof shingle peeler device 30 is more clearly depicted. This embodiment is referred to herein as the "fourth embodiment." In this fourth embodiment, the saw blade 60, the horizontal arm 64, the skiis 70, the square frame 114, the side bars 120, the wedge 66, and the bag 52, if used, are all the same as that disclosed in the second embodiment. The roof shingle peeler device 30 also uses the same hoist 38 and return hoist 54 for traversing the roof deck 32.

This fourth embodiment of the roof shingle peeler device 30, like the third embodiment, comprises a belt drive or pulley motor 160 to operate the saw blades 60. In the preferred embodiment, the pulley motor 160 is a 15 amp, 3½ horsepower electric alternating current (AC) or gas motor which is supported by the square frame 114. The pulley motor 160 is also energized by 110 volts. As this is the same voltage that is provided by a typical house electrical outlet, the pulley motor 160 is ideal for use with the roof shingle peeler device 30 as it eliminates the necessity of having to provide a portable electrical generator to run the motor 61 of the original and second embodiments. As illustrated in FIG. 15, the pulley motor 160 comprises a motor 162, two pulleys 164 connected by a driving belt 166, and a drive shaft 168 for engaging the saw blades 60. A cover 158 is provided for protecting the users from potential injury resulting from the saw blades 60, especially when in use.

Figure 16:
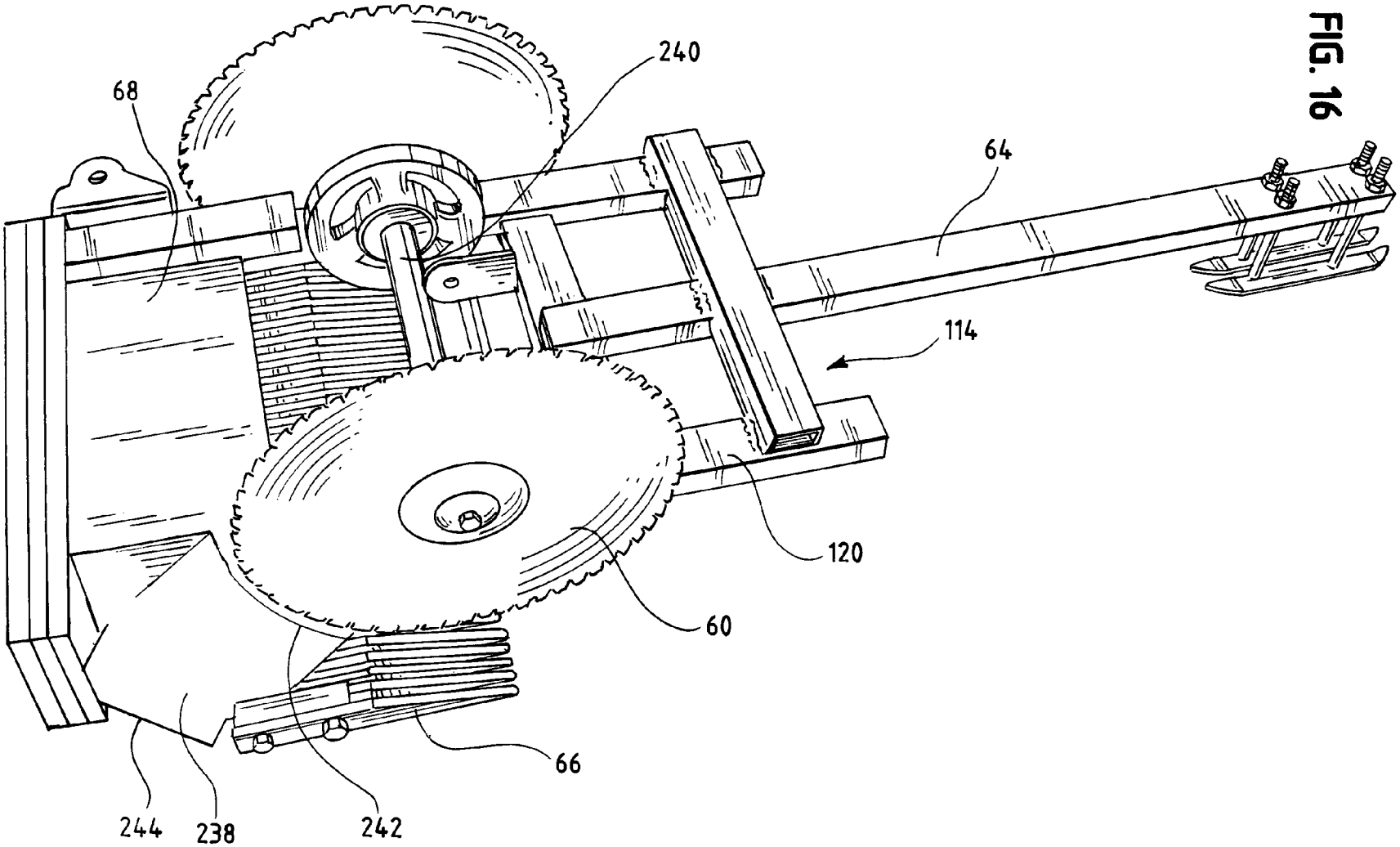
FIG. 16 is a top perspective view, with portions removed, of the fourth embodiment of the roof shingle peeler device.

This fourth embodiment provides two differences over the first three embodiments. First, the device provides dual saw blades 60, one located on the left side of the frame 68 and the other located on the right side of the frame 68. The dual saw blades 60 are attached to one another by an axle 240 (FIG. 16). The dual saw blades 60 enable the shingles to be cut on both sides of the predefined section 76 (FIG. 2) rather than on just one side as in the first three embodiments.

Figure 17:
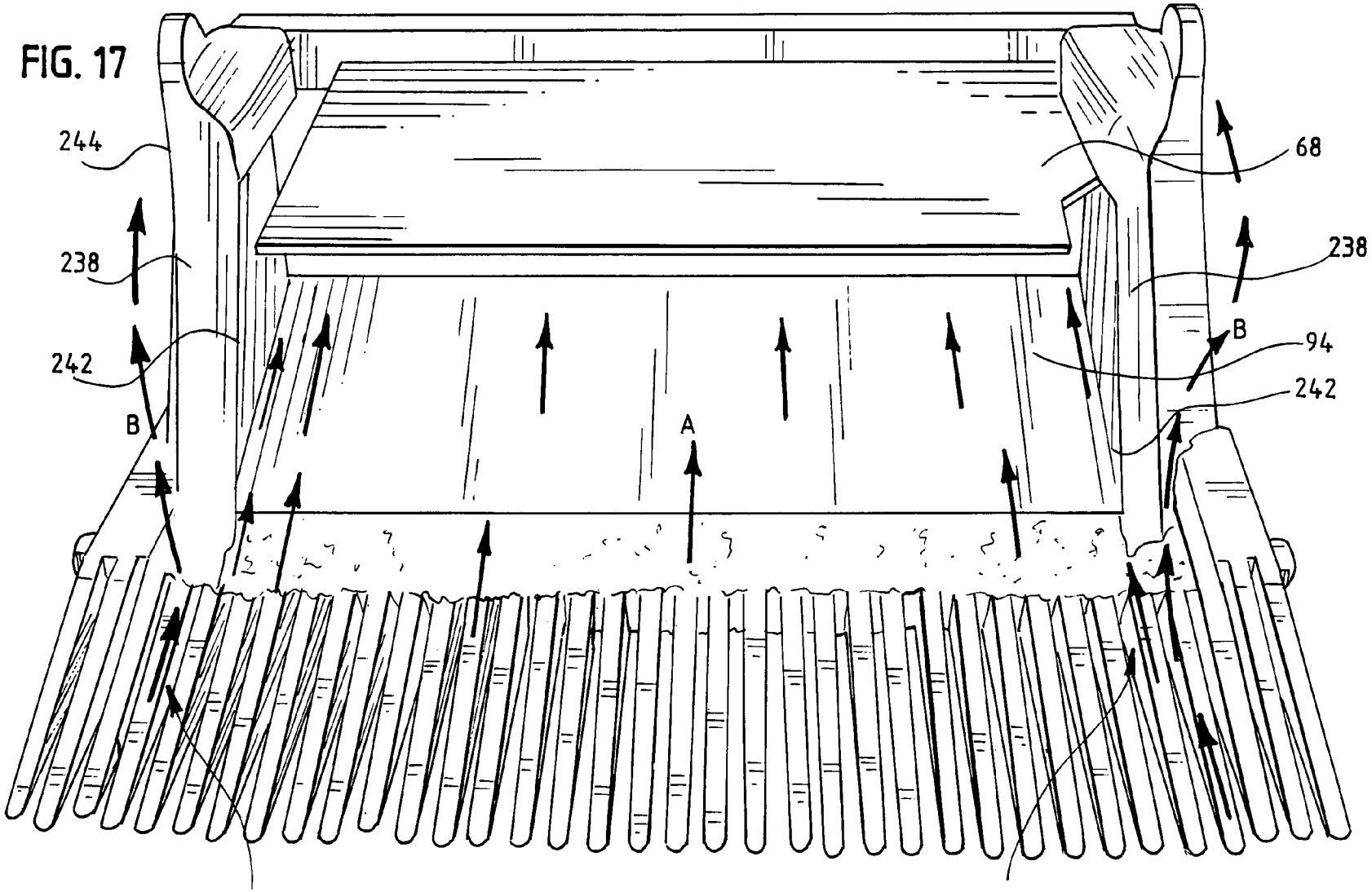
FIG. 17 is a front view, with portions removed, of the fourth embodiment of the roof shingle peeler device and, in particular, illustrating the directional flow of the shingles into and around the duct as the roof shingle peeler device proceeds to the crest of the roof deck during a strip run.

Second, the frame 68 is provided with dual vertical flanges 238 on opposite sides of the frame 68 as illustrated in FIG. 16. The purpose of the dual vertical flanges 238 is to separate the predefined section 76 of shingles from the shingles that remain attached to the roof deck 32. The dual flanges 238 each have a flange leading edge 242 and a flange trailing edge 244. In the preferred embodiment, the flange leading edge 242 coincides with the front sides of the frame 68 and the entrance to the duct 94. From the flange leading edge 242, the dual flanges 238 taper outwardly from the frame 68 to the flange trailing edge 244. In this manner, upon the dual saw blades 60 cutting the shingles, the predefined section 76 of shingles, also referred to in this embodiment as the center section, proceeds along directional line A (FIG. 17) straight into the duct 94. The shingles separated from opposite sides of the predefined section 76 of shingles, also referred to in this embodiment as the left section and the right section, are directed, using the dual vertical flanges 238, along directional line B and around the frame 68 and duct 94. As a result, the roof shingle peeler device 30 is enabled to proceed from the base 44 to the crest 46 of the roof deck 32 without being inhibited or restricted by the shingles remaining attached to the roof deck 32 and not yet removed.

Thus, the benefits of this fourth embodiment are that: (1) the pulley motor provides a more convenient and efficient motor; (2) in the original and second embodiments, the roof shingle peeler device started to remove shingles from the roof deck from either the left or right side of the roof deck depending upon whether the saw blade was located on the right or left side of the device, respectively. With the pulley motor, wedge, horizontal arm, and skiis all positioned in the same vertical centerline and coacting with the dual saw blades, the roof shingle peeler device in this fourth embodiment can, like the third embodiment, start to remove shingles from the roof deck from any location on the roof deck; (3) the dual saw blades improve upon the third embodiment as this device can cut the shingles simultaneously on both the left and right sides of the roof shingle peeler device 30; (4) the dual vertical flanges assists in the division or separation of the shingles from the predefined section and also enable the movement of the device traversing up the roof deck without being restrained or inhibited by the shingles that remains attached to the roof deck; (5) the roof shingle peeler device can operate with or without the bag; and (6) provides a more balanced device.

Figure 18:
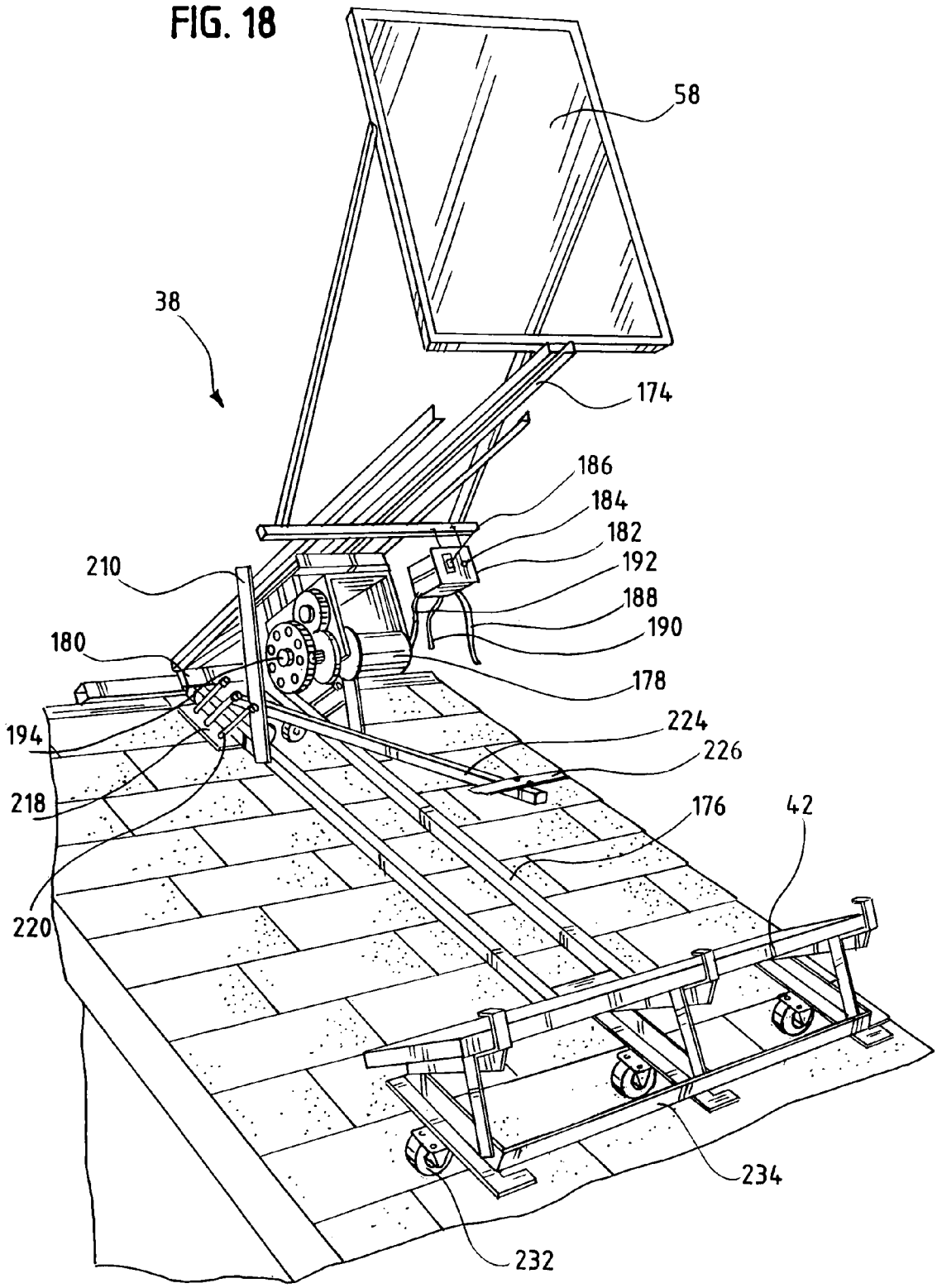
FIG. 18 is a side perspective view of the hoist for the roof shingle peeler device.
Figure 19:
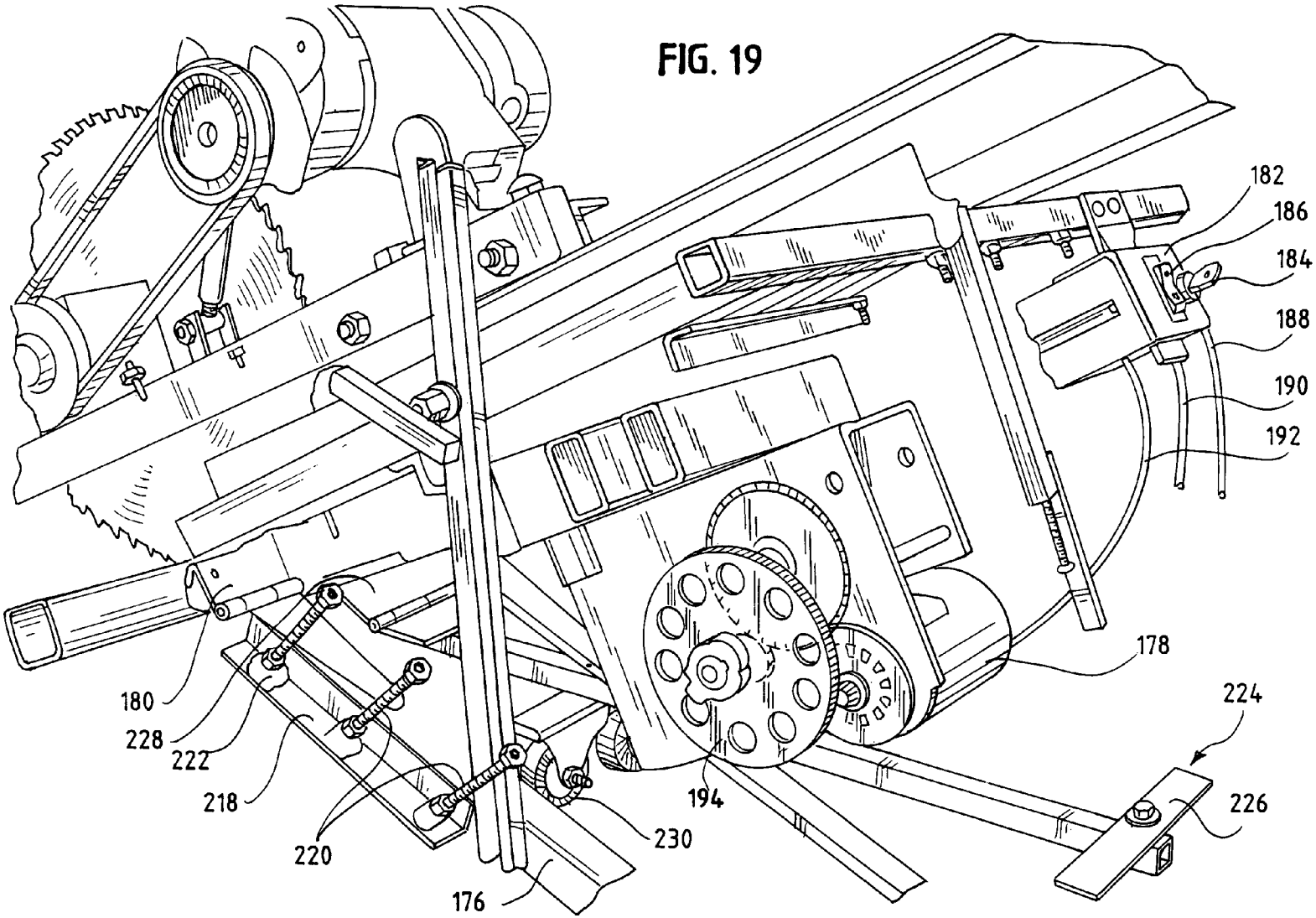
FIG. 19 is an enlarged side perspective view, with portions removed, of the hoist for the roof shingle peeler device.

FIG. 18 more clearly illustrates the hoist 38. The hoist 38 comprises a directional guide 174, dual arms 176, and the platform 42. The directional guide 174 and dual arms 176 are connected by a hinge 180 (see also FIG. 19). The hinge 180 enables the hoist 38 to accommodate any roof angle 36 such that the directional guide 174 parallels the front side of the roof deck 32 and the dual arms 176 parallel the back side of the roof deck 32 to the platform 42. A hoist adjustable means 210 (FIG. 20) is utilized to secure the directional guide 174 and the dual arms 176 of the hoist 38 into this position relative to the front and back sides of the roof deck 32. The hoist adjustable means 210 comprises two parallel beams 212 separated by a roller 214 which is securely attached to the side of the directional guide 174. Preferably, the roller 214 is permitted to slide in either direction between the two parallel beams 212. As the roller 214 slides between the two parallel beams 212, the directional guide 174 and the dual arms 176 pivot around the hinge 180 (FIG. 19) to accommodate the particular roof angle 36 of the roof deck 32. Upon reaching the particular roof angle 36 and the desired position of the directional guide 174 and dual arms 176 in relation to the roof deck 32, a lever 216 attached to the roller 214 is used to tighten the hoist 38 into position.

While the hoist 38 is positioned to accommodate the roof angle 36, it is also secured to the roof deck 32. An L-bracket 218, attached to each dual arm 176, and cleats 220, attached to each L-bracket 218, are also used to secure the hoist 38 to the roof deck 32. The L-bracket 218 is preferably welded to each dual arm 176 and provides pockets 222 to retain the cleat 220 to the L-bracket 218. The pockets 222 also facilitate each cleat 220 to be inserted directly into the roof deck 32 thereby securing the hoist 38 to the roof deck 32, especially when in use. Preferably, six cleats 220 per L-bracket 218 on each dual arm 176 is used. Alternatively, it is contemplated that more or less cleats 220 or any other means may be used to secure the hoist 38 to the roof deck 32 provided the hoist 38 is secured to the roof deck 32 sufficient to pull the roof shingle peeler device 30 up the roof deck 32 as described herein.

Referring back to FIG. 18, a control box 182 is provided to control the operation of the roof shingle peeler device 30 and the hoist 38. The control box 182 comprises on/off power control switches 184 and 186. The on/off power control switch 184 controls the electrical power of the roof shingle peeler device 30. A power cord 188 provides continuous electrical power source to the control box 182. If the on/off power control switch 184 is toggled to the off position, the roof shingle peeler device 30 and, in particular, the motor 61 will not be energized and prohibited from operating. If the on/off power control switch 184 is toggled to the on position, the electrical power supplied from the power cord 188 will continue through the control box 182 and through a motor cord 190 to permit the operation of the motor 61 and ultimately the roof shingle peeler device 30. Likewise, the on/off power control switch 186 operates in the same manner as the on/off power control switch 184 except that the on/off power control switch 186 controls the operation of the hoist 38. The hoist 38 provides a hoist motor cord 192 that extends from the control box 182 to a hoist motor 178 to operate the hoist 38. As the roofer 40 (FIG. 1) stands on the platform 42 to operate the device, the control box 182 is conveniently positioned for access by the roofer 40. The control box 182 is also more clearly illustrated in FIG. 19.

Figure 20:
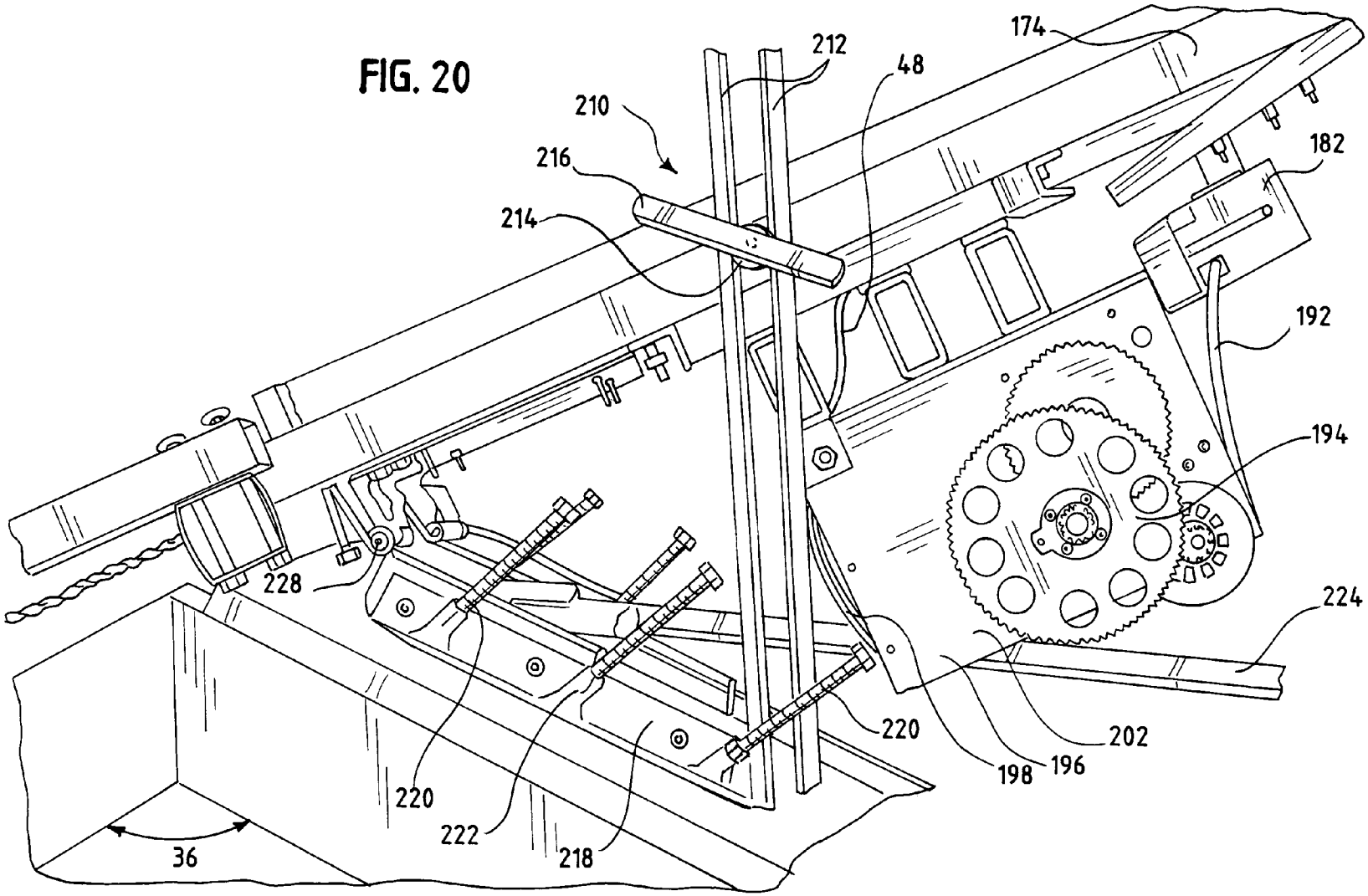
FIG. 20 is an enlarged side perspective view, with portions removed, of the hoist for the roof shingle peeler device.
Figure 21:
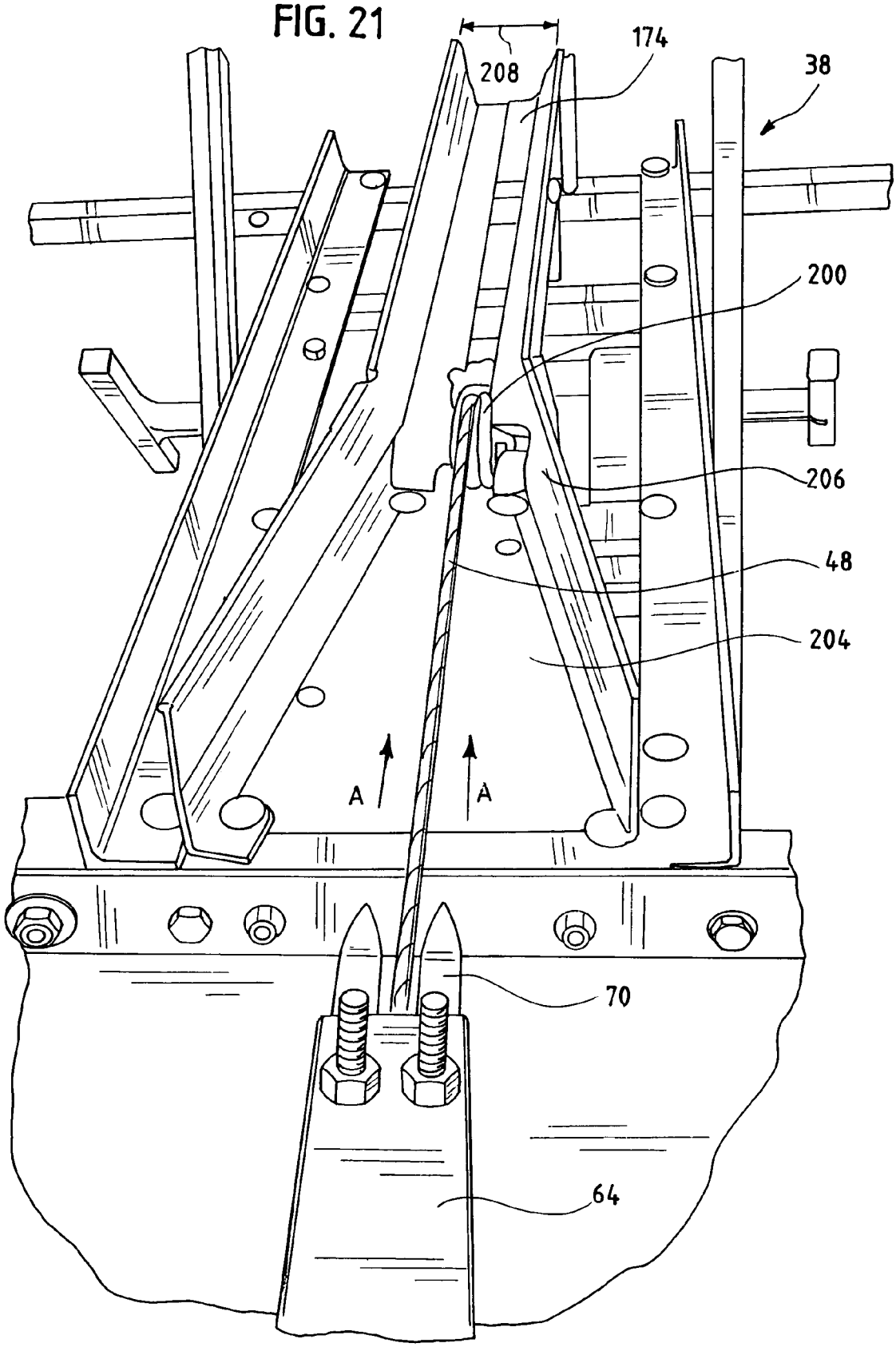
FIG. 21 is a top perspective view, with portions removed, of the hoist as the roof shingle peeler device is shown entering the hoist.

The hoist motor 178 engages, as illustrated in FIG. 20, a set of gears 194 for controlling a hoist pulley system 196. The hoist pulley system 196 provides a housing 202 for the gear drive shafts (not illustrated) and a cable drum 198 for encapsulating the hoist cable 48 that is fitted around a hoist pulley 200 (FIG. 21). This hoist pulley system 196 is used to pull the roof shingle peeler device 30 from the base 44 to the crest 46 of the roof deck 32.

Figure 22:
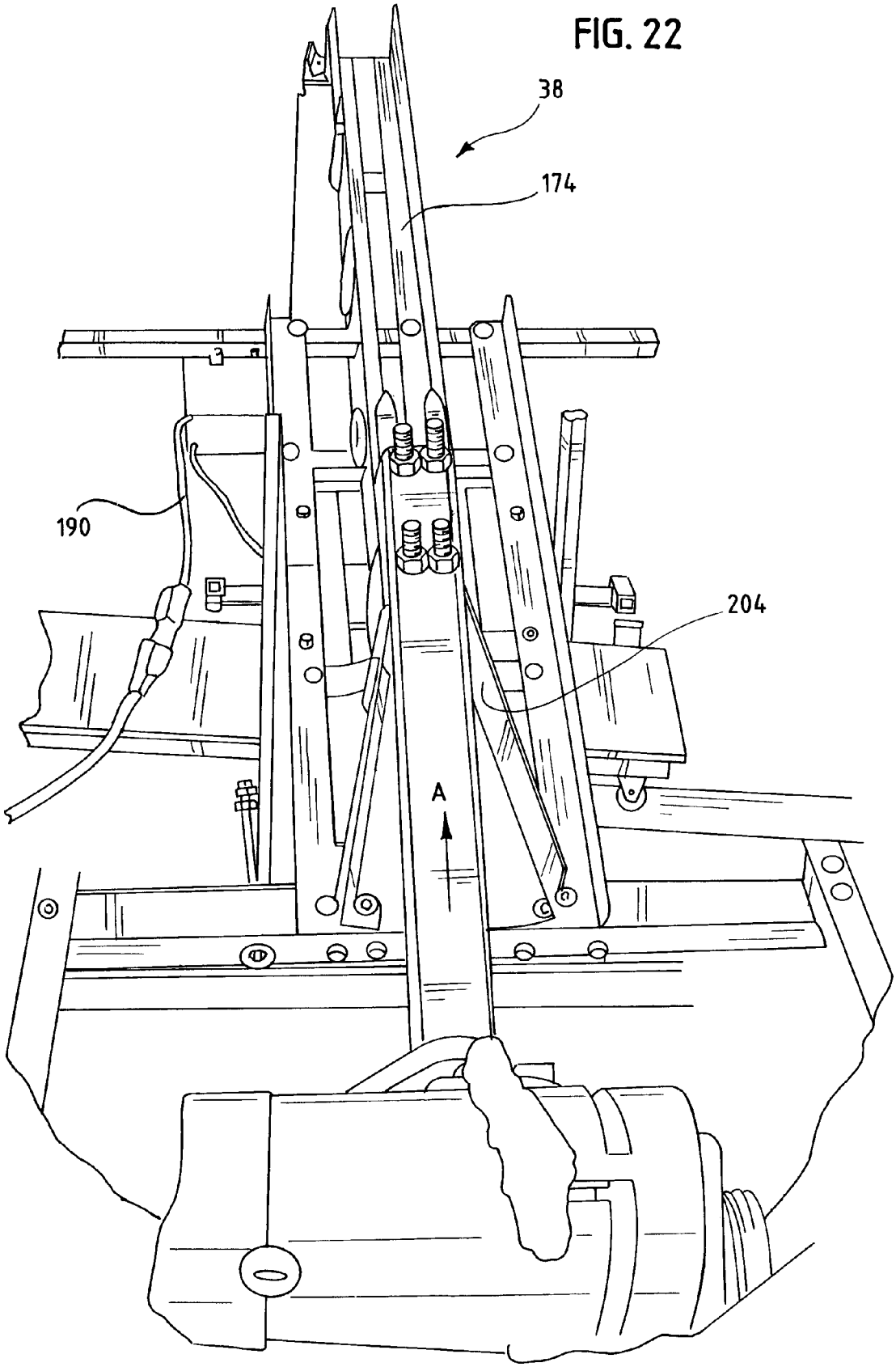
FIG. 22 is a top perspective view, with portions removed, of the hoist as the roof shingle peeler device is shown continuing into the directional guide of the hoist.
Figure 23:
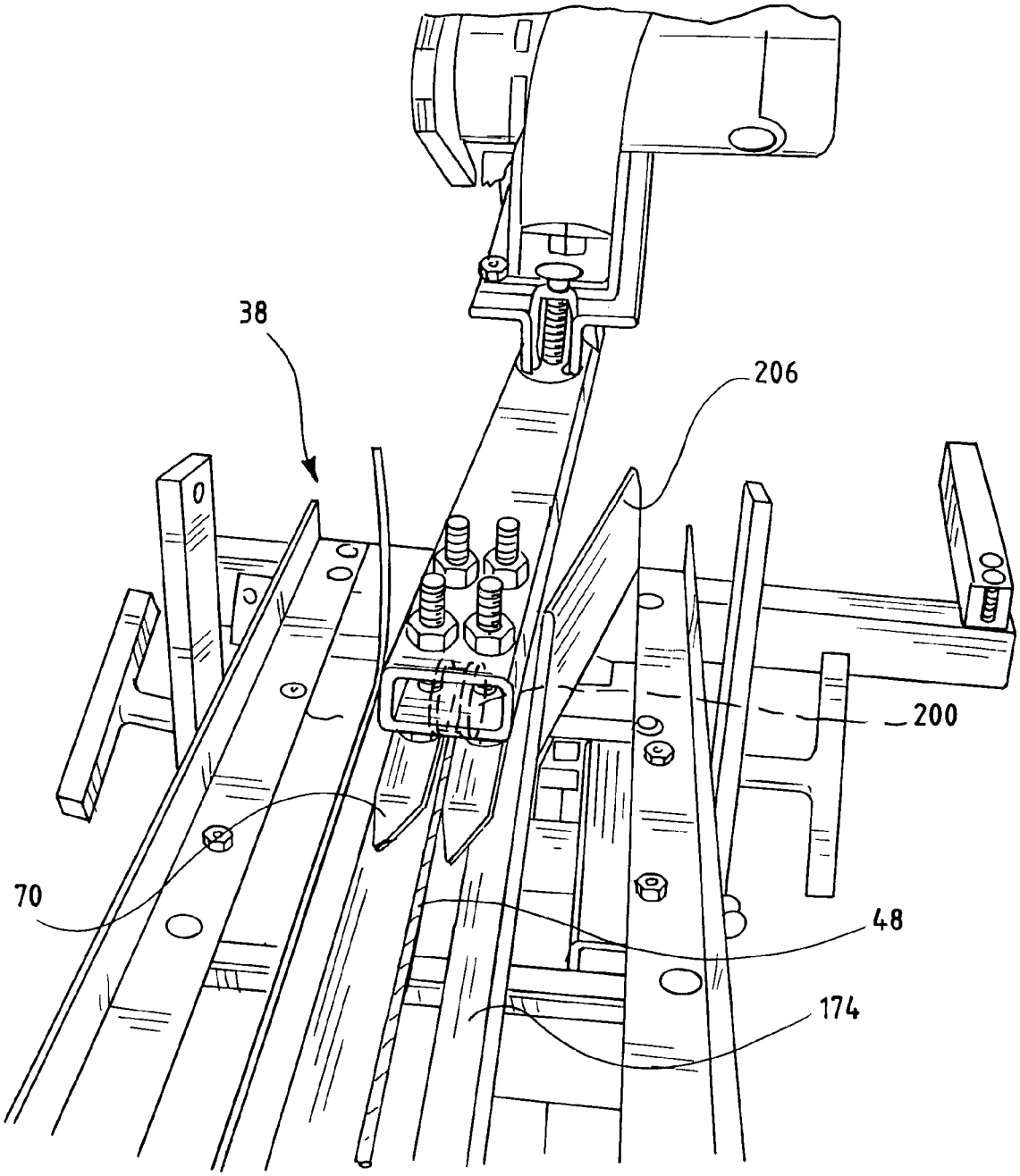
FIG. 23 is an end perspective view, with portions removed, of the hoist and, in particular, illustrating the roof shingle peeler device as it enters the hoist.

As illustrated in FIGS. 21 through 23, when the on/off power control switch 186 is toggled to the on position, the hoist 38 begins to operate. As it begins to operate, the hoist motor 178 powers the set of gears 194 (FIG. 20) which engage the hoist pulley system 196 and begin to rotate the cable drum 198 for turning the hoist cable 48 and, thereby, pulling the roof shingle peeler device 30 up the roof deck 32. As the roof shingle peeler device 30 reaches the hoist 38 being pulled along direction A, the hoist 38 provides a funneling guide 204 that is fitted with tapered sides 206 to engage the skiis 70 and to redirect, if necessary, the skiis 70 and the horizontal arm 64 into the directional guide 174. In the preferred embodiment, the directional guide 174 has a guide width 208 that is slightly larger than the width of the horizontal arm 64. As a result, upon the skiis 70 and horizontal arm 64 entering the directional guide 174, as illustrated in FIG. 22, the roof shingle peeler device 30 is positioned within the center of and becomes stabilized within the hoist 38. As illustrated in FIG. 23, this is facilitated by the hoist pulley 200 and the cable 48 being centered between the skiis 70. The directional guide 174 is also of sufficient length to accommodate the distance 98 of the horizontal arm 64 such that the roof shingle peeler device 30 may fully reach the crest 46 of the roof deck 32 thereby permitting the wedge 66 to completely remove the shingles 34 within the predefined section 76 all the way up to the crest 46 of the roof deck 32.

After the predefined section 76 of shingles 34 is removed from the roof deck 32 and the roof shingle peeler device 30 is repositioned for the next strip run, the hoist 38 is likewise correspondingly repositioned. To reposition the hoist 38, the cleats 220 must first be removed from the roof deck 32. Then, a stepdown lever 224 (FIGS. 18 and 19) is used to lift the hoist 38 from the roof deck 32. Upon depression of a bar 226, located on the stepdown lever 224, towards the roof deck 32, the opposite end of the stepdown lever 224 provides an upward force on a secondary hinge 228 attached to the hoist 38. The secondary hinge 228 pivots in an upward direction away from the roof deck 32 such that the weight of the hoist 38 transfers to and rests on a set of wheels 230 attached perpendicularly to the stepdown lever 224. With the weight on the wheels 230 and the hoist 38 no longer attached to the roof deck 32, the hoist 38 can be rolled and repositioned along the roof deck 32 to correspond to the same repositioning of the roof shingle peeler device 30 for the next strip run. A second set of wheels 232 are attached to a platform support 234 (FIG. 18) to permit the dual arms 176 and the platform 42 to be repositioned as well. Upon repositioning, the stepdown lever 224 is released such that the secondary hinge 228 pivots towards the roof deck 32 placing the weight of the hoist 28 back on the roof deck 32. The cleats 220 are then reinserted into the roof deck 32 to again secure the hoist 38 to the roof deck 32.

Thus, there has been provided a unique method and apparatus for removing shingles from a roof. While the invention has been described in conjunction with a specific embodiment, it is evident that many alternatives, modifications and variations will be apparent to those skilled in the art in light of the foregoing description. Accordingly, it in intended to embrace all such alternatives, modifications and variations as fall within the spirit and scope of the appended claims.

What is claimed is:

1. A device for removing shingles and nails from a roof deck having a base and a crest, comprising:

saw means for cutting the shingles, the saw means for cutting the shingles situated in a substantially vertical orientation and aligned in a cutting plane;

means for operating the saw means for cutting the shingles;

a wedge having a plurality of teeth with an outermost tooth on each side defining a width of the wedge between them, the teeth having a top surface, a bottom surface, a leading edge, and a trailing edge, each tooth separated from an adjacent tooth by a channel, the channel defining an opening between the leading edge of adjacent teeth and a closed notch at the trailing edge of adjacent teeth; each channel formed between the adjacent teeth in the wedge extending equi-distant between the adjacent teeth from the opening in the leading edge to the closed notch in the trailing edge, the top surface of the plurality of teeth in the wedge upwardly tapering from the leading edge to the trailing edge;

a plate having a front, a back, a top side, a bottom side, a left side and a right side and defining a width between the left side and the right side, the width of the plate being substantially the same as the saw means for cutting the shingles, the plate situated in a substantially vertical orientation with the front and the back of the plate aligned in the cutting plane directly behind the saw means for cutting the shingles, the top side of the plate positioned directly behind the saw means for cutting the shingles, and a completely open space defined adjacent to the saw means for cutting the shingles and to the left side and right side of the plate;

a horizontal arm having a proximal end attached to the plate and extending outwardly a length from the plate to a distal end, the horizontal arm substantially rigid along the length between the proximal end and the distal end;

means for adjusting the height of the distal end of the horizontal arm in relation to the roof deck to adjust the position of the leading edge of the teeth of the wedge in relation to the roof deck;

first mechanical pulling means for pulling the device from the base of the roof deck to the crest of the roof deck;

the saw means for cutting the shingles mounted directly above and substantially perpendicular to the wedge, the width of the wedge larger than the saw means for cutting shingles with one or more of the plurality of teeth positioned on either side of the saw means for cutting shingles wherein the plurality of teeth of the wedge lifting the shingles from the roof deck and the combination of the plurality of teeth and the channels removing the nails from the roof deck wherein as the nail enters the channel at the leading edge, a portion of the nail engages the opposed teeth, as the nail slides through the channel toward the trailing edge, the portion of the nail engaging the opposed teeth is gradually lifted upwardly by the upwardly tapering teeth thereby completely removing the nail from the roof deck when the nail reaches the closed notch of the wedge; the saw means for cutting the shingles cutting the shingles into a left section and a right section directly above the wedge as the device is pulled up the roof deck in a strip run, the left section and right section of the shingles passing the saw means for cutting the shingles with the left side of the plate continuously directing the left section of shingles to the left side of the plate and the right side of the plate continuously directing the right section of shingles to the right side of the plate with a portion of the shingles in each of the left section of shingles and the right section of shingles passing over the wedge and through the completely open space and adjacent to the plate during the strip run.

2. The device of claim 1 wherein the saw means for cutting the shingles is a saw blade.

3. The device of claim 1 and further comprising a ski, the horizontal arm defining a length between a first end attached to the supporting bracket and a second end attached to the ski, the ski being parallel to the horizontal arm and attached to the horizontal arm.

4. The device of claim 1 wherein the first mechanical pulling means for pulling the device up the roof deck is a hoist.

5. The device of claim 1 and further comprising a second pulling means for pulling the device down the roof deck.

6. The device of claim 1 wherein the first mechanical pulling means for pulling the device from the base of the roof deck to the crest of the roof deck comprises a motor operated mechanical device and a cable, the cable being releasably attached adjacent to the proximal end of the horizontal arm and extending along the length of the horizontal arm, through the means for adjusting the height of the distal end of the horizontal arm, and attaching to the motor operated mechanical device.

7. The device of claim 6 wherein the means for adjusting the height of the distal end of the horizontal arm reducing the yawing of the cable when the motor operated mechanical device is pulling on the cable to pull the device from the base of the roof deck to the crest of the roof deck.

* * * * *